US011164433B2

(12) United States Patent
Zhang

(10) Patent No.: US 11,164,433 B2
(45) Date of Patent: Nov. 2, 2021

(54) BOX EDGE SECURITY DEVICE

(71) Applicant: Edge Security Products, LLC, Waxhaw, NC (US)

(72) Inventor: Ningsheng Zhang, Waxhaw, NC (US)

(73) Assignee: Edge Security Products, LLC, Waxhaw, NC (US)

( * ) Notice: Subject to any disclaimer, the term of this patent is extended or adjusted under 35 U.S.C. 154(b) by 0 days.

(21) Appl. No.: 16/963,088

(22) PCT Filed: Jan. 31, 2019

(86) PCT No.: PCT/US2019/016105
§ 371 (c)(1),
(2) Date: Jul. 17, 2020

(87) PCT Pub. No.: WO2019/152683
PCT Pub. Date: Aug. 8, 2019

(65) Prior Publication Data

US 2021/0174656 A1 Jun. 10, 2021

Related U.S. Application Data

(60) Provisional application No. 62/625,039, filed on Feb. 1, 2018.

(51) Int. Cl.
*G08B 13/24* (2006.01)
*B65D 55/06* (2006.01)
*E05B 73/00* (2006.01)

(52) U.S. Cl.
CPC ..... *G08B 13/2434* (2013.01); *B65D 55/06* (2013.01); *E05B 73/0023* (2013.01); *E05B 73/0029* (2013.01)

(58) Field of Classification Search
CPC ..... G08B 12/2434; G08B 13/1463; B65D 55/06; E05B 73/0023; E05B 73/0029; E05B 72/0017; Y01T 70/5004
(Continued)

(56) References Cited

U.S. PATENT DOCUMENTS 6,092,401 A * 7/2000 Sankey ..... E05B 73/0029 100/30
6,237,375 B1 * 5/2001 Wymer ..... E05B 73/0082 248/551

(Continued)

FOREIGN PATENT DOCUMENTS

WO 9315294 A1 8/1993

OTHER PUBLICATIONS

International Search Report and Written Opinion from related international application, PCT/US2019/016105 filed on Jan. 31, 2019, all pages cited in its entirety.

*Primary Examiner* — Eric Blount
(74) *Attorney, Agent, or Firm* — Burr & Forman LLP

(57) ABSTRACT

A box edge security device, for a merchandise box having adjacent structural portions connected together along an edge, includes an edge cleat and a tag assembly. The edge cleat is adapted to be attached around an edge of a merchandise box, the merchandise box having a first structural portion and a second structural portion that are connected to one another along the edge, such that a first portion of the edge cleat is disposed against the first structural portion of the merchandise box and a second portion of the edge cleat is disposed against the second structural portion of the merchandise box. The tag assembly interlocks with the edge cleat and includes an electronics assembly, contained within a housing, that forms at least part of an alarm system. The electronics assembly may include an electronic article surveillance (EAS) tag.

20 Claims, 22 Drawing Sheets

(58) Field of Classification Search
USPC ..... 340/572.1–572.8
See application file for complete search history.

(56) References Cited

U.S. PATENT DOCUMENTS

| | | | | |
|---|---|---|---|---|
| 6,374,648 | B1 * | 4/2002 | Mitsuyama | E05B 73/0023 206/308.1 |
| 6,499,241 | B1 * | 12/2002 | Vila-Martinez | B65D 55/06 206/807 |
| 8,057,871 | B2 * | 11/2011 | Cai | G08B 13/2437 428/34.3 |
| 8,305,219 | B2 * | 11/2012 | Yang | G08B 13/2434 340/572.8 |
| 9,328,536 | B2 * | 5/2016 | Shute | E05B 73/0035 |
| 9,934,665 | B1 * | 4/2018 | Zhang | G08B 13/2434 |
| 10,121,340 | B2 * | 11/2018 | Yang | G08B 13/2434 |
| 10,593,178 | B2 * | 3/2020 | Zhang | G08B 25/10 |
| 11,037,421 | B2 * | 6/2021 | Zhang | G08B 13/1463 |
| 2004/0123311 | A1 * | 6/2004 | Farrar | E05B 73/0023 720/728 |
| 2006/0170550 | A1 * | 8/2006 | Marsilio | G08B 13/2434 340/568.2 |
| 2006/0208045 | A1 * | 9/2006 | Chandaria | B65D 5/0236 229/102 |
| 2007/0029385 | A1 * | 2/2007 | Kovac | G06K 19/07758 235/435 |
| 2007/0120669 | A1 * | 5/2007 | Belden, Jr. | G08B 13/1445 340/568.2 |
| 2008/0190920 | A1 * | 8/2008 | Farrar | E05B 73/0023 220/4.22 |
| 2009/0223260 | A1 * | 9/2009 | Conti | E05B 45/005 70/57.1 |
| 2010/0133126 | A1 * | 6/2010 | Shute | E05B 47/004 206/216 |
| 2010/0315239 | A1 * | 12/2010 | Yang | G08B 13/2434 340/572.9 |
| 2013/0169440 | A1 * | 7/2013 | Bruhwiler | G08B 13/2434 340/572.9 |
| 2014/0191870 | A1 * | 7/2014 | Valiulis | G08B 13/2448 340/572.1 |
| 2015/0077256 | A1 * | 3/2015 | Maddox | G06Q 10/08 340/572.1 |

* cited by examiner

BOX EDGE SECURITY DEVICE

CROSS-REFERENCE TO RELATED APPLICATIONS

This applications claims the benefit of U.S. provisional application No. 62/625,039, filed Feb. 1, 2018, the entire contents of which is hereby incorporated by reference.

FIELD OF THE PRESENT INVENTION

The present invention relates generally to security devices used to protect merchandise or other objects, and, in particular, to box edge security devices.

BACKGROUND

Shoplifting has been a problem in a wide variety of retail and other settings for centuries. In the last few decades, tools and systems have been developed to help combat shoplifting. One common type of system is an electronic article surveillance (EAS) system, which commonly includes EAS tags, a transmitter, a receiver, and an alarm system. Tags are attached to respective merchandise items, while the transmitter and receiver are generally located at or near the exit of the retail location being protected such that individuals leaving the store must pass through the area of the transmitter and receiver on their way out. In a typical system, the transmitter transmits signals through a detection zone. When an EAS tag enters the zone, the tag responds and creates a signal or a change or disturbance in the original signal transmitted by the transmitter, and the result is detected by the receiver. The receiver reports this result to the alarm system so that further action can be taken. For example, an audible alarm may sound such that store personnel can be made aware that someone is trying to leave the store with an active EAS tag. Because tags are typically removed or deactivated by a cashier at point of sale, the alarm may thus be interpreted to mean that the individual is carrying a merchandise item which may not have been paid for.

It will be appreciated that in such a system, it is the EAS tag that is being detected by the transmitter/receiver and not the actual merchandise itself. Thus, an EAS system can be circumvented by removing the EAS tag from the merchandise item, which therefore makes it important to provide physical tags that are difficult to remove. Tags are thus typically housed in some sort of device that also serves the function of attaching the tag to the merchandise in a manner makes it more difficult for a shoplifter to tamper with or otherwise remove the EAS tag from the merchandise.

One known type of device is a cable wrap security device. Examples of this type of device are disclosed in U.S. Pat. Nos. 7,497,101 and 9,234,371. This type of security device commonly includes a housing for a ratchet mechanism, a separate housing for an EAS tag, and a cable that is routed through both the two housings and wrapped around the merchandise. The ratchet mechanism is used to tighten the cable around the merchandise such that the security device is not removable from the merchandise without being released and loosened. The device further includes a locking mechanism that prevents releasing the cable without a specifically configured key or other specialized equipment that is generally only accessible to authorized personnel of the store or other retail establishment. In some applications, the cable of the cable wrap security device also prevents a potential shoplifter from opening or otherwise tampering with the packaging containing the merchandise in an attempt to access the merchandise within the packaging.

Unfortunately, cable wrap security devices, while possibly suitable for their intended purposes, may not be ideal for the protection of all types of merchandise items. For example, merchandise items in the form of openable boxes may sometimes still be opened, using varying amounts of force, to access the contents thereof. Although cable wrap security devices may prevent this to some degree, the cables do not always prevent such boxes from being opened and their contents accessed and even removed, thus rendering such cable wrap security devices useless. Furthermore, cable wrap security devices are not suitable for some package geometries, such as long, narrow boxes, because it is possible to manipulate the cables relative to the boxes until they can be removed entirely. In addition, cable wrap security devices are typically expensive and not easy to use. A significant portion of this high cost is due to the cables themselves. Use of the devices generally requires the cables to be unwound and rewound, which is tedious and time-consuming; if the cables are not rewound, the cables tend to get tangled, rendering the devices inoperable. Still further, it is highly inconvenient to stack multiple packages with cable wrap security devices installed thereon because of the way the thick housings of such devices are disposed in the middle of the packages.

Therefore, a need exists for improved merchandise security devices that can be used to reliably prevent openable merchandise boxes from being opened.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

Broadly defined, the present invention according to one aspect is a box edge security device, for merchandise, that contains an electronics assembly, all according to at least one embodiment shown and/or described herein.

In a feature of this aspect, the electronics assembly is an electronic article surveillance (EAS) tag. Broadly defined, the present invention according to another aspect is a box edge security device, for merchandise, including: an edge cleat according to at least one embodiment shown and/or described herein; and a tag assembly, including an electronics assembly, according to at least one embodiment shown and/or described herein that interlocks with the edge cleat.

In a feature of this aspect, the electronics assembly is an electronic article surveillance (EAS) tag. Broadly defined, the present invention according to another aspect is a merchandise item protected by a box edge security device that contains an electronics assembly, all according to at least one embodiment shown and/or described herein.

Broadly defined, the present invention according to another aspect is a merchandise item protected by a box edge security device, including: a merchandise box; an edge cleat according to at least one embodiment shown and/or described herein; and a tag assembly, including an electronics assembly, according to at least one embodiment shown and/or described herein that interlocks with the edge cleat.

Broadly defined, the present invention according to another aspect is a box edge security device, for a merchandise box having adjacent structural portions connected together along an edge, including: an edge cleat adapted to be attached around an edge of the merchandise box, the merchandise box having a first structural portion and a second structural portion that are connected to one another along the edge, such that a first portion of the edge cleat is disposed against the first structural portion of the merchandise box and a second portion of the edge cleat is disposed against the second structural portion of the merchandise box; and a tag assembly that interlocks with the edge cleat and includes an electronics assembly, contained within a housing, that forms at least part of an alarm system.

In a feature of this aspect, the electronics assembly includes an electronic article surveillance (EAS) tag.

In another feature of this aspect, the edge cleat includes two flat portions arranged at an angle to one another and adapted to fit around the edge of a merchandise box whose first and second structural portions are flat.

In a further feature, the angle is a right angle.

In another further feature, each of the two flat portions includes a box-facing surface, on its underside, to which a pressure-sensitive adhesive (PSA) is applied.

In other further features, the tag assembly includes a housing in which the EAS tag is disposed; the tag assembly includes a lock plug that biased into engagement with the edge cleat; the edge cleat includes an aperture that engages the lock plug; the tag assembly includes a box sensor that detects the proximity of a merchandise box to the tag assembly; and/or the box sensor includes a spring-loaded plunger that extends through an aperture in the edge cleat and contacts a surface of the merchandise box.

In other further features, respective interlocking structures are provided near the periphery of the underside of the tag assembly and on an outwardly-facing surface of one of the two flat portions of the edge cleat, respectively, such that the tag assembly may be coupled to the edge cleat by sliding the tag assembly onto the edge cleat by sliding the respective interlocking structure of the tag assembly onto the respective interlocking structure of the edge cleat; the underside of the tag assembly includes a recessed groove near its periphery, wherein the edge cleat includes a profiled edge on the outwardly-facing surface, and wherein the recessed groove of the underside of the tag assembly couples with the profiled edge of the edge cleat to interlock the tag assembly to the edge cleat; and/or the tag assembly includes a lock plug that is biased into engagement with the edge cleat such that the once the tag assembly is fully coupled onto the edge cleat by sliding the tag assembly onto the edge cleat via the interlocking structures of the tag assembly and the edge cleat, respectively, the tag assembly cannot be removed from the edge cleat until the lock plug is manually disengaged from the edge cleat.

In other further features, an outwardly-facing surface of one of the first and second structural portions of the edge cleat includes a flat channel that accommodates a strap around the merchandise box; and/or a raised protuberance is arranged on each side of the flat channel and extends up into a recess in an underside of the tag assembly to prevent the box edge security device from being moved sideways relative to the strap.

In another further feature, the edge cleat is electrically conductive and forms a sense loop that is broken if the edge cleat is removed from a merchandise item.

In another further feature, the edge cleat is initially provided in a flat, unfolded configuration and is bent, folded, creased, or otherwise manipulated to fit around the edge of the merchandise box.

In another feature of this aspect, the electronics assembly includes a user-perceptible alarm, and wherein removal of at least one of the edge cleat and the tag assembly from the merchandise box triggers the alarm.

Broadly defined, the present invention according to another aspect is a merchandise item protected by a box edge security device, including: a merchandise box having a first structural portion and a second structural portion that are connected to one another along an edge; an edge cleat attached around the edge of a merchandise box such that a first portion of the edge cleat is disposed against the first structural portion of the merchandise box and a second portion of the edge cleat is disposed against the second structural portion of the merchandise box; and a tag assembly that interlocks with the edge cleat and includes an electronics assembly, contained within a housing, that forms at least part of an alarm system.

Broadly defined, the present invention according to another aspect is an electronic article surveillance (EAS) system, including: an edge cleat adapted to be attached around an edge of a merchandise box, the merchandise box having a first structural portion and a second structural portion that are connected to one another along the edge, such that a first portion of the edge cleat is disposed against the first structural portion of the merchandise box and a second portion of the edge cleat is disposed against the second structural portion of the merchandise box; a tag assembly that interlocks with the edge cleat and includes an electronic article surveillance (EAS) tag contained within a housing; and a surveillance gate that detects the presence of the EAS tag when the EAS tag enters a detection zone.

Broadly defined, the present invention according to another aspect is a box edge security device, for a merchandise box having adjacent structural portions connected together along an edge, including: an edge cleat having a first structural portion and a second structural portion, the first and second structural portions being hard, solid structures that are integrally formed and are arranged at a fixed angle to one another, the edge cleat being attachable around an openable edge of the merchandise box, the merchandise box having a first structural portion and a second structural portion that are connected to one another along the openable edge, such that the hard, solid, first portion of the edge cleat is disposed against the first structural portion of the merchandise box and the hard, solid second portion of the edge cleat is disposed against the second structural portion of the merchandise box; and a tag assembly that interlocks with the edge cleat and includes an electronics assembly, contained within a housing, that forms at least part of an alarm system.

In a feature of this aspect, the electronics assembly includes an electronic article surveillance (EAS) tag. In further features, the tag assembly includes a housing in which the EAS tag is disposed; the tag assembly includes a lock plug that is biased into engagement with the edge cleat, and wherein the edge cleat includes an aperture that engages the lock plug; the tag assembly includes a box sensor that detects the proximity of a merchandise box to the tag assembly; and/or the box sensor includes a spring-loaded plunger that extends through an aperture in the edge cleat and contacts a surface of the merchandise box.

In another feature of this aspect, the first and second structural portions of the edge cleat are arranged at a right angle to one another. In further features, each of the first and second structural portions of the edge cleat includes a box-facing surface, on its underside, to which a pressure-sensitive adhesive (PSA) is applied; respective interlocking structures are provided near the periphery of an underside of the tag assembly and on an outwardly-facing surface of one of the first and second structural portions of the edge cleat, respectively, such that the tag assembly can be coupled to the edge cleat by sliding the tag assembly onto the edge cleat by sliding the respective interlocking structure of the tag assembly onto the respective interlocking structure of the edge cleat; the underside of the tag assembly includes a recessed groove near its periphery, wherein the edge cleat includes a profiled edge on the outwardly-facing surface, and wherein the recessed groove of the underside of the tag assembly couples with the profiled edge of the edge cleat to interlock the tag assembly to the edge cleat; the tag assembly includes a lock plug that is biased into engagement with the edge cleat such that the once the tag assembly is fully coupled onto the edge cleat by sliding the tag assembly onto the edge cleat via the interlocking structures of the tag assembly and the edge cleat, respectively, the tag assembly cannot be removed from the edge cleat until the lock plug is manually disengaged from the edge cleat; an outwardly-facing surface of one of the first and second structural portions of the edge cleat includes a flat channel that accommodates a strap around the merchandise box; a raised protuberance is arranged on each side of the flat channel and extends up into a recess in an underside of the tag assembly to prevent the box edge security device from being moved sideways relative to the strap; the edge cleat is electrically conductive and forms a sense loop that is broken if the edge cleat is removed from a merchandise item; the edge cleat is initially provided in a flat, unfolded configuration and is bent, folded, creased, or otherwise manipulated to fit around the edge of the merchandise box; and/or the electronics assembly includes a user-perceptible alarm, and wherein removal of at least one of the edge cleat and the tag assembly from the merchandise box triggers the alarm.

In another feature of this aspect, the box edge security device further includes a strap adapted to extend peripherally around the box and to extend over the first and second structural portions of the edge cleat. In a further feature, the tag assembly interlocks with the edge cleat so as to imprison the strap in a narrow gap therebetween, and wherein the strap extends continuously through the gap from one side of the tag assembly to the other.

Broadly defined, the present invention according to another aspect is a box edge security device, for a merchandise box having adjacent first and second structural portions connected together along an edge, including: a tag assembly that includes an electronics assembly, contained within a housing, that forms at least part of an alarm system; an edge cleat adapted to be attached around the edge of the merchandise box, the edge cleat having a first planar body portion and a second planar body portion, wherein the first planar body portion is a base that receives, and interlocks with, the tag assembly and the second planar body portion is integral with the first planar body portion and extends at an angle from the first planar body portion such that the first planar body portion is disposed against the first structural portion of the merchandise box and the second planar body portion is disposed against the second structural portion of the merchandise box; and a strap that extends between the tag assembly and the edge cleat.

Broadly defined, the present invention according to another aspect is a merchandise item protected by any of the foregoing box edge security devices.

Broadly defined, the present invention according to another aspect is an EAS system using any of the foregoing box edge security devices.

Broadly defined, the present invention according to another aspect is a box edge security device, for a merchandise box having adjacent structural portions connected together along an edge, including: a cleat; a tag assembly that interlocks with the cleat and includes an electronics assembly, contained within a housing, that forms at least part of an alarm system; and a conductive sense loop that is electrically connected to circuitry in the tag assembly such that the alarm system is triggered if the conductive sense loop is broken; wherein the cleat, tag assembly, and conductive sense loop are adapted to be attached to a first structural portion of the merchandise box.

In a feature of this aspect, the box edge security device of claim 40, wherein the conductive sense loop is embodied in a conductive sense layer attached directly to the first portion of the merchandise box. In further features, the alarm system is triggered if the conductive sense layer is broken; the alarm system is triggered if the tag assembly is removed from the conductive sense layer; the merchandise box further has a second structural portion, wherein the first and second structural portions are connected to one another along an edge, and wherein the conductive sense layer is attached around the edge; the conductive sense layer is attached directly to the first structural portion of the merchandise box, wherein the cleat is attached over the conductive sense layer, and wherein the tag assembly is attached to the cleat; the box security device further includes a protective layer that is attached to, and covers, the conductive sense layer, and wherein the cleat is attached to the protective layer; the conductive sense layer is a conductive tape; the conductive tape includes at least one conductor affixed lengthwise to a length of tape; the at least one conductor is a wire, and wherein the length of tape is a length of adhesive tape; the conductive sense layer is a conductive ink; and/or the conductive sense layer is a metal foil.

In another feature of this aspect, the merchandise box further has a second structural portion, wherein the first and second structural portions are connected to one another along an edge, and wherein the cleat is an edge cleat that is attached around the edge.

Broadly defined, the present invention according to another aspect is an edge cleat for a merchandise box that includes having adjacent first and second structural portions connected together along an edge, including: a first portion adapted to be disposed against a first structural portion of the merchandise box; a second portion adapted to be disposed against a second structural portion of the merchandise box, wherein the first structural portion and the second structural portion are connected to one another along an edge, and wherein the edge cleat is adapted to be attached around the edge; one or more interface structures or elements that are adapted to interlock with a tag assembly; wherein a top surface of the first portion of the edge cleat includes a shallow channel for receiving a strap; and wherein the second portion of the edge cleat is not as wide as the first portion, is not adapted to fit under the strap, and is disposed only to one side or the other of the strap, all such that the edge cleat may be positioned beneath the strap after the strap has already been installed around the merchandise box.

Broadly defined, the present invention according to another aspect is a box edge security device, for a merchandise box having adjacent structural portions connected together along an edge, including: an edge cleat adapted to be attached around an edge of the merchandise box, the merchandise box having a first structural portion and a second structural portion that are connected to one another along the edge, such that a first portion of the edge cleat is disposed against the first structural portion of the merchandise box and a second portion of the edge cleat is disposed against the second structural portion of the merchandise box; and a tag assembly that interlocks with the edge cleat and includes an electronics assembly, contained within a housing, that forms at least part of an alarm system; and a strap adapted to extend peripherally around the box and to extend over the first structural portion of the edge cleat; wherein the second portion of the edge cleat is not as wide as the first portion of the edge cleat, is not adapted to fit under the strap, and is disposed only to one side or the other of the strap, all such that the edge cleat may be positioned beneath the strap after the strap has already been installed around the merchandise box.

Broadly defined, the present invention according to another aspect is an edge cleat for a merchandise box that includes having adjacent first and second structural portions connected together along an edge, including: a first portion adapted to be disposed against a first structural portion of the merchandise box; a second portion adapted to be disposed against a second structural portion of the merchandise box, wherein the first structural portion and the second structural portion are connected to one another along an edge, and wherein the edge cleat is adapted to be attached around the edge; one or more interface structures or elements that are adapted to interlock with a tag assembly; wherein a top or outer surface of the first portion of the edge cleat includes a shallow channel for receiving a strap; and wherein a top or outer surface of the second portion of the edge cleat also includes a shallow channel, collinear with the shallow channel of the first portion of the edge cleat, for receiving the strap.

Broadly defined, the present invention according to another aspect is a box edge security device, for a merchandise box having adjacent structural portions connected together along an edge, including: a cleat having a planar portion with a slot penetrating therethrough; and a tag assembly that interlocks with the cleat and includes an electronics assembly, contained within a housing, that forms at least part of an alarm system, and further includes a box proximity sensor that extends from a bottom thereof and extends through the slot in the cleat; wherein the cleat and tag assembly are adapted to be attached to a first structural portion of the merchandise box with the box proximity sensor in contact with the merchandise box; and wherein the tag assembly may be translated relative to the cleat with the box proximity sensor remaining within the slot in the cleat during such translation.

Broadly defined, the present invention according to another aspect is a box edge security device, for a merchandise box having adjacent structural portions connected together along an edge, including: an edge cleat adapted to be attached around an edge of the merchandise box, the merchandise box having a first structural portion and a second structural portion that are connected to one another along the edge, such that a first portion of the edge cleat is disposed against the first structural portion of the merchandise box and a second portion of the edge cleat is disposed against the second structural portion of the merchandise box; and a tag assembly that interlocks with the edge cleat and includes an electronics assembly, contained within a housing, that forms at least part of an alarm system, and further includes a pair of sense loop contacts extending therefrom.

In a feature of this aspect, the edge cleat includes a pair of sense loop openings through which the sense loop contacts may establish electrical contact with a conductive sense layer on the merchandise box.

In another feature of this aspect, the conductive sense layer is a conductive tape. In further features, the conductive tape includes at least one conductor affixed lengthwise to a length of tape; and/or the at least one conductor is a wire, and wherein the length of tape is a length of adhesive tape.

In another feature of this aspect, the conductive sense layer is a conductive ink.

In another feature of this aspect, the conductive sense layer is a metal foil.

Broadly defined, the present invention according to another aspect is a box edge security device, for merchandise, that contains an electronics assembly, all according to at least one embodiment shown and/or described herein.

Broadly defined, the present invention according to another aspect is a box edge security device, for merchandise, including: an edge cleat according to at least one embodiment shown and/or described herein; and a tag assembly, including an electronics assembly, according to at least one embodiment shown and/or described herein that interlocks with the edge cleat.

Broadly defined, the present invention according to another aspect is a merchandise item protected by a box edge security device that contains an electronics assembly, all according to at least one embodiment shown and/or described herein.

Broadly defined, the present invention according to another aspect is a merchandise item protected by a box edge security device, including: a merchandise box; an edge cleat according to at least one embodiment shown and/or described herein; and a tag assembly, including an electronics assembly, according to at least one embodiment shown and/or described herein that interlocks with the edge cleat Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
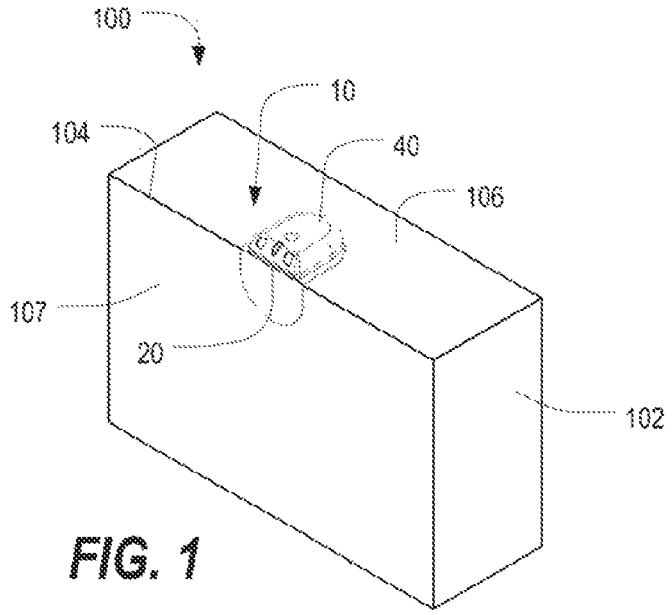
FIG. 1 is an isometric view of a merchandise item protected by a box edge security device.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is an isometric view of a merchandise item 100 protected by a box edge security device 10 in accordance with one or more preferred embodiments of the present invention. As shown therein, the merchandise item 100 is packaged in a box 102 having an openable edge 104. As used herein, the term "openable edge" refers to an edge of a box or similar object, where a tab, fold, or the like is arranged to meet another portion of the box to provide at least partial enclosure thereof, but which may be separated from such box portion, without damaging the overall integrity of the box, so as to enable the box to be opened. In some embodiments, the openable edge may be sealed or otherwise affixed to such box portion, while in other embodiments the openable edge is inserted into the box portion without being sealed or otherwise affixed thereto.

Figure 2:
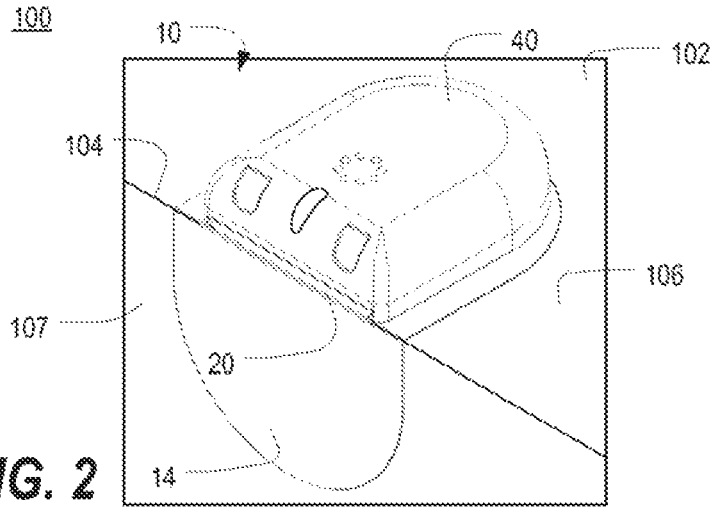
FIG. 2 is an isometric view of the merchandise item and box edge security device of FIG. 1.
Figure 3:
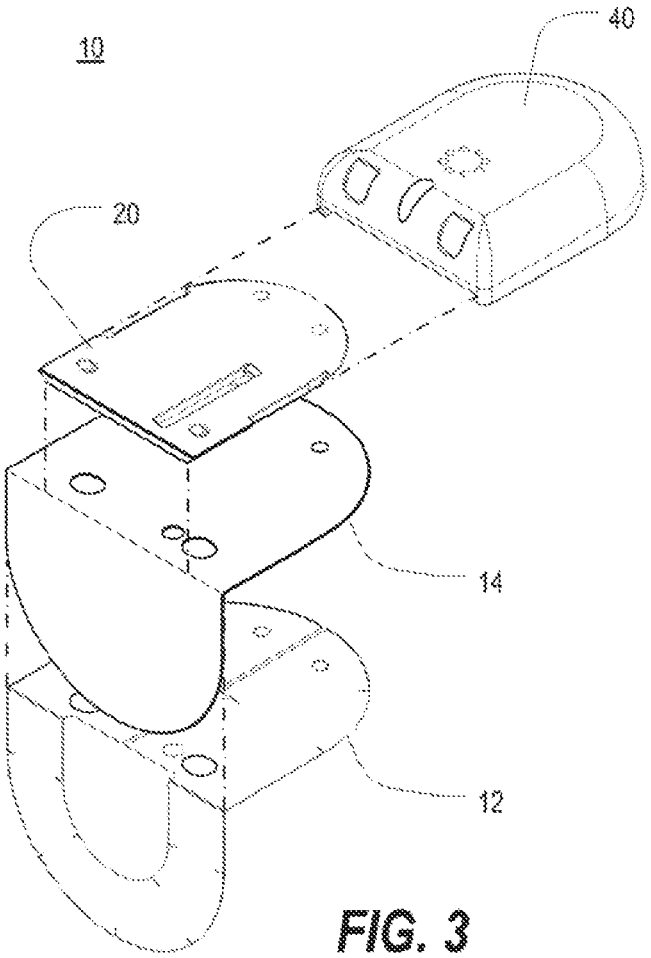
FIG. 3 is an exploded isometric view of the merchandise item and box edge security device of FIG. 2.

FIG. 2 is an enlarged isometric view of the merchandise item 100 and box edge security device 10 of FIG. 1, and FIG. 3 is an exploded isometric view of the merchandise item and box edge security device 10 of FIG. 2. As shown therein, the box edge security device 10 includes an edge cleat 20, a conductive sense layer 12, a protective layer 14, and a tag assembly 40.

Figure 4:
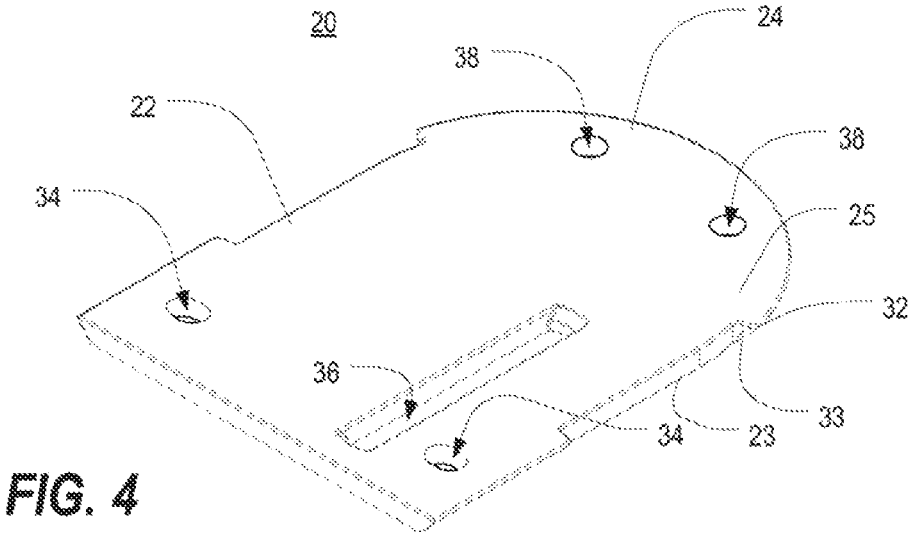
FIG. 4 is a top isometric view of the edge cleat of FIG. 2.
Figure 5:
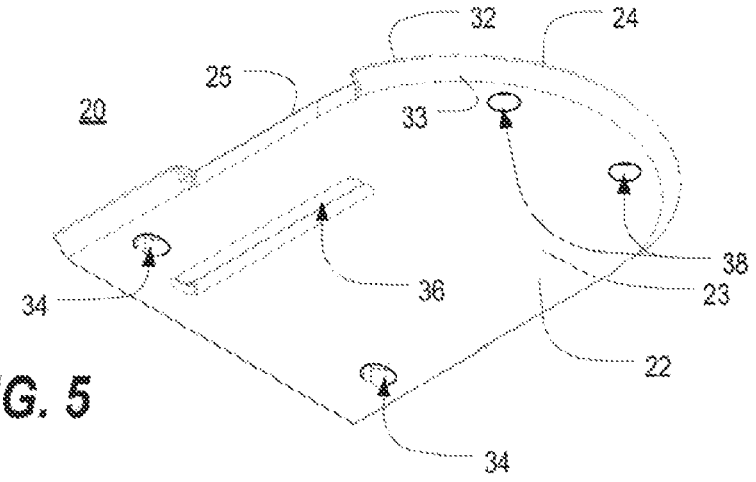
FIG. 5 is bottom isometric view of the edge cleat of FIG. 2.

FIGS. 4 and 5 are a top isometric view and a bottom isometric view, respectively, of the edge cleat 20 of FIG. 2. As shown therein, the edge cleat 20 includes a planar body 22 whose underside surface 23 is generally flat. The contours of the outer surface 25 of the planar body 22 are somewhat less important than those of the underside surface 23 in the sense that they need not be flat, but in at least some embodiments the outer surface 25 is also flat for the purpose of manufacturing ease and/or some other purpose. In at least some embodiments, the distal end 24 of the planar body 22 is curved so as to avoid corners that might be more easily pried from the box 102. However, the curvature may vary from that shown in the drawings, and in some embodiments, shapes having vertices may be employed, particularly if their angles are relatively wide (and thus not sharp).

Figure 6:
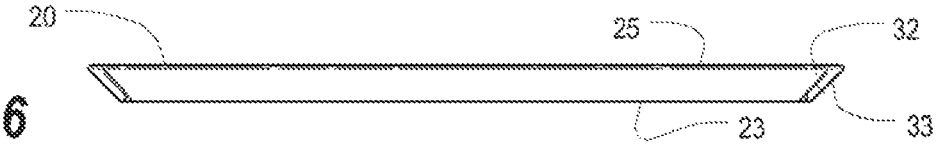
FIG. 6 is a rear view of the edge cleat of FIG. 2.

In at least this embodiment, the planar body 22 of the edge cleat 20 further includes a tag assembly interface 32, one or more lock apertures 34, a box sensor opening 36, and a pair of electric sense loop openings 38. In the illustrated embodiment, the tag assembly interface 32 includes one or more profiled edges that interlock with corresponding structures on the underside of the tag assembly 40. As shown in FIG. 6, the illustrated edges are inwardly-angled from the outer surface 25 to the underside surface 23 that may be joined to corresponding surfaces on the tag assembly 40, by sliding the tag assembly 40 onto the edge cleat 20, to form a secure joint. However, other angled joints, tongue and groove joints, and the like may additionally or alternatively be utilized. In the illustrated embodiment, there are two lock apertures 34. The lock apertures 34, box sensor opening 36, and electric sense loop openings 38 are arranged to engage corresponding structures or elements on the tag assembly 40. Their use and operation are at least partially described in a separate section.

The planar body 22 is formed or otherwise manufactured integrally, preferably via injection molding or the like. The edge cleat 20 is preferably made of plastics, such as polyethylene terephthalate (PET) or ABS. In at least one contemplated commercial embodiment, the planar body 22 is approximately 2.0 mm thick.

Figure 7:
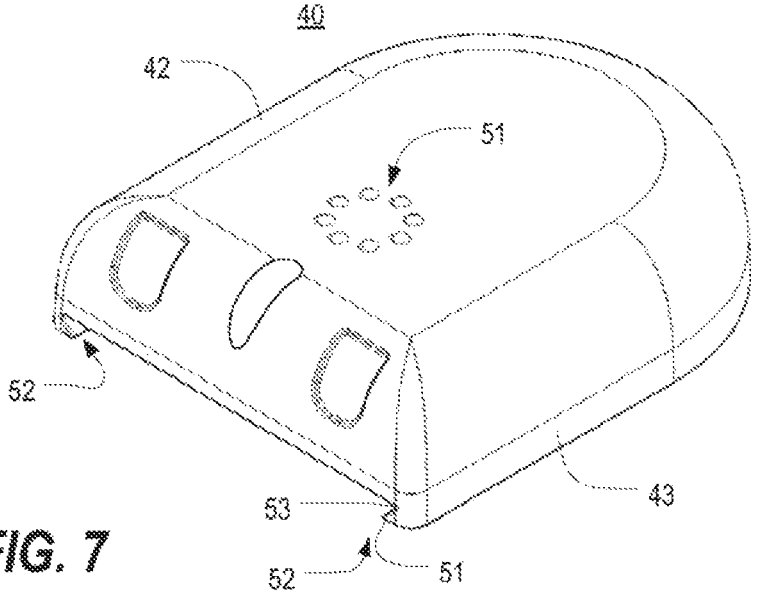
FIG. 7 is a top isometric view of the tag assembly of FIG. 2.
Figure 8:
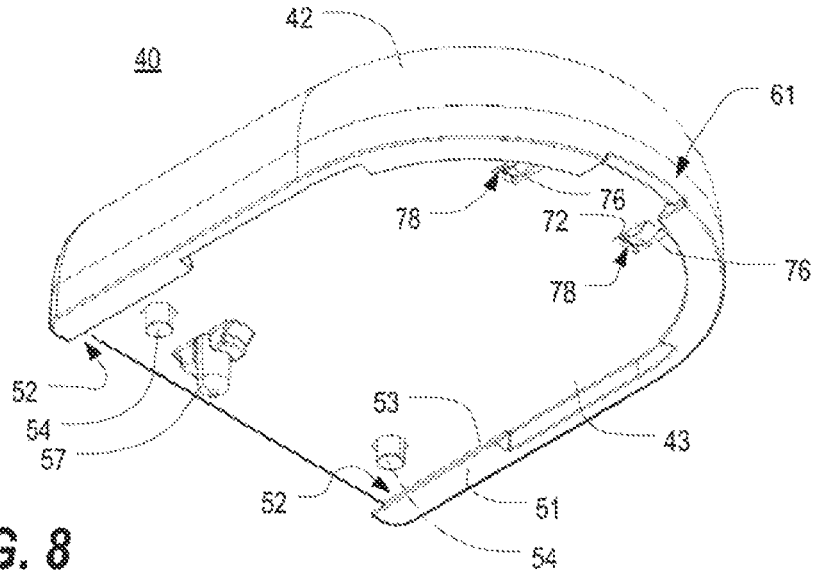
FIG. 8 is a bottom isometric view of the tag assembly of FIG. 2.
Figure 9:
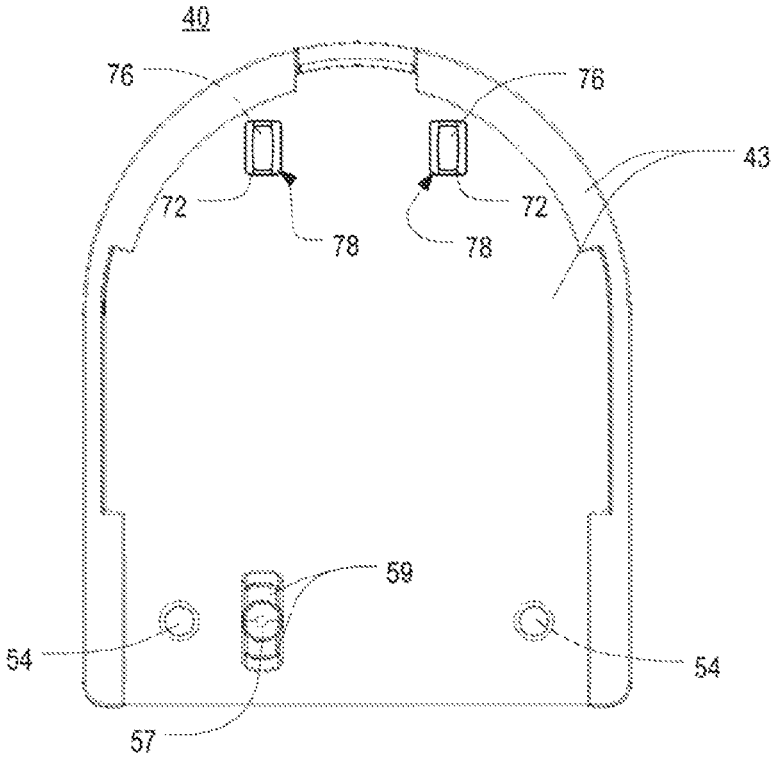
FIG. 9 is a bottom view of the tag assembly of FIG. 2.

FIGS. 7, 8, and 9 are a top isometric view, a bottom isometric view, and a bottom view, respectively, of the tag assembly 40 of FIG. 2. The tag assembly 40 includes, among other things, an upper housing 42 and a lower housing 43 that together support and contain an electronics assembly (perhaps best shown in FIGS. 10 and 11, described below). In various embodiments, the upper housing 42 and lower housing 43 may or may not be separable, although in some embodiments they may not be separable by a consumer but may be separable by certain authorized personnel.

The lower housing 43 includes a cleat interface 52 located on its underside. In the illustrated embodiment, the cleat interface 52 includes a profiled structure or structures whose shape and contours correspond to the profiled edges of the tag assembly interface 32. The illustrated structures include a rim 51 and a recessed, angled, groove 53 extending discontinuously around a substantial portion of the periphery of the underside of the tag assembly 40. The angled groove 53 may be coupled or joined to the corresponding angled profile of the tag assembly interface 32 on the edge cleat 20 through lateral movement of the tag assembly 40 relative to the cleat 20. However, other angled joints, tongue and groove joints, and the like may additionally or alternatively be utilized. The corresponding interfaces 32,52 enable the tag assembly 40 to be easily but temporarily coupled to the edge cleat 20 in a way that prevents the two structures 20,40 from being pulled apart by hand once locked in place as described in a separate section.

Figure 10:
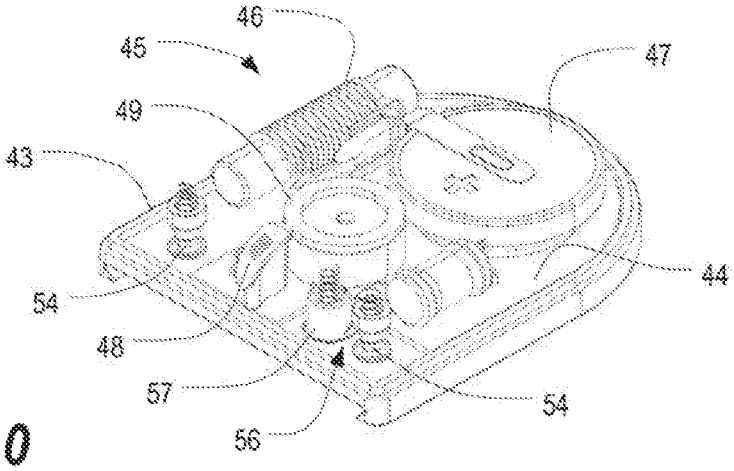
FIG. 10 is a top isometric view of the tag assembly of FIG. 7, shown with the upper housing removed.
Figure 11:
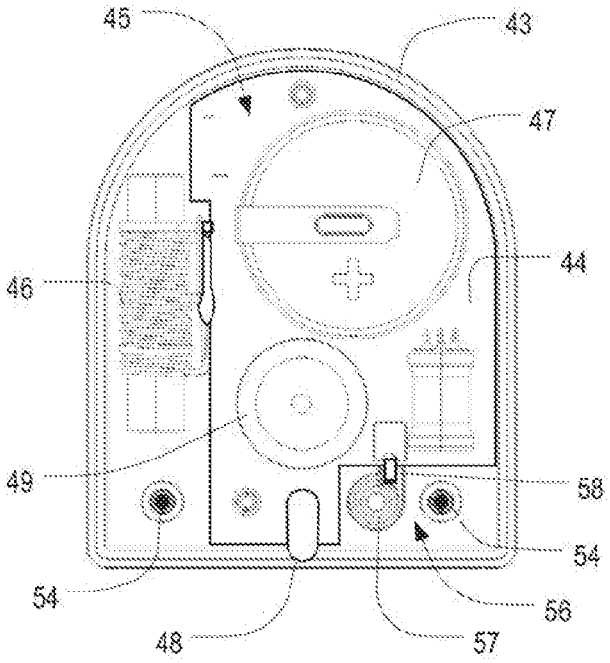
FIG. 11 is a top view of the tag assembly of FIG. 10.
Figure 12:
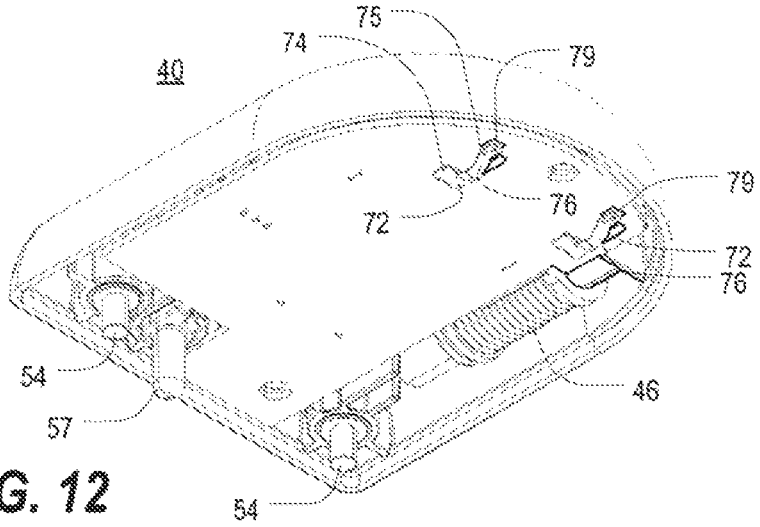
FIG. 12 is a bottom isometric view of the tag assembly of FIG. 7, shown with the lower housing removed.

The electronics assembly 45 is shown generally in FIGS. 10 and 11, which are a top isometric view and a top view, respectively, of the tag assembly 40 of FIG. 7 shown with the upper housing 42 removed, and FIG. 12, which is a bottom isometric view of the tag assembly 40 of FIG. 7 shown with the lower housing 43 removed. The electronics assembly 45 is primarily supported and interconnected by, a printed circuit board (PCB) 44. Power for the electronics assembly 45 is primarily supplied by a battery 47, which may be, for example, a type CR2450 3V lithium battery. In various preferred embodiments, the electronics assembly 45 includes an EAS tag 46, which in the illustrated embodiment is mounted on the upper surface of the PCB 44, and the PCB 44 is primarily carried within lower housing 43. However, in other embodiments (not shown), a single unitary housing encloses the EAS 46 and PCB 44, or other EAS tag structure, and the single housing may or may not include an access opening with a cover. In various embodiments, the PCB 44 and the upper and lower housings 42,43 (or the single housing and access opening cover) may be permanently connected, e.g., with an adhesive, weld, one or more fasteners, and/or the like, such that once assembled, the EAS tag is inaccessible to consumers, would-be thieves, and/or the like, while in other embodiments, the upper housing 42 may be removed from the lower housing 43 (or the PCB 44 may be removed from the single housing, or the like), preferably when the tag assembly 40 is not attached to an edge cleat. The EAS tag is configured to be detectable when the EAS tag is present in a predetermined detection zone located, for example, at or near the door or other entrance point of a retail establishment. The EAS tag may be configured to work within an EAS security system. For example, the EAS tag may be a magnetic tag such as in an electromagnetic (EM) system or in an acousto-magnetic (AM) system or an electronic circuit and antenna as in a radio frequency (RF) system. As another example, the EAS tag may be configured work within a microwave system.

In addition to or instead of the EAS tag, the security device 10 may include other wireless devices. For example, the security device 10 may include an active or passive RFID tag. The RFID tag may be used to store and/or communicate information about the object for security or inventory control purposes.

Figure 13:
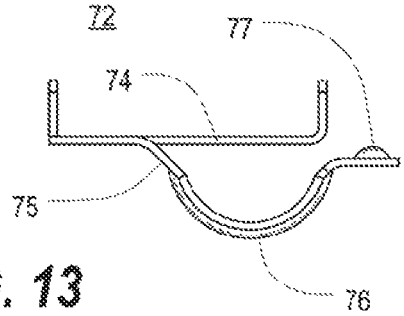
FIG. 13 is an enlarged side view of one of the contacts of FIG. 12, shown in isolation.

The security device 10 preferably includes an alarm system that includes an audio alarm, such as a piezo-electric siren, or a visual alarm, such as a high-intensity flashing light, that may be triggered in response to one or more circumstances. In this regard, the electronics assembly 45 may include at least an audio speaker 49 (shown in FIGS. 10 and 11) and appropriate circuitry to activate the speaker in an alarm state, and the housing (for example, the upper housing 42) may include one or more openings, such as a speaker grill 51 (shown in FIG. 7), located adjacent the speaker 49. Also, the electronics assembly 45 may include a light, such as a light-emitting diode (LED), and appropriate circuitry to activate the light in an alarm state. In some embodiments, the light is disposed at one end of a light pipe 48 whose distal end extends through an opening in the housing such that light generated by the LED or other source is visible outside the housing. In other embodiments, the light itself may extend at least partially through an opening in the housing 42 such that at least a portion of the LED is visible outside the housing 42. The LED or other light may be used as an indicator (e.g., by providing a constant light or a blinking on/off light) of the existence of one or more particular conditions or circumstances, e.g., that the security device 10 has power, that the lock plugs are in the locked position, that the alarm is armed, or that the alarm has been triggered. Different blinking light patterns, different light colors, or more than one different light may in some embodiments be used to indicate different conditions or circumstances. The box edge security device 10 preferably includes one or more components for causing the alarm system to enter an alarm state and thereby generate one or more alarms. For example, the box edge security device 10 of FIGS. 1-3 may further include a sense loop that may be used to trigger such alarm state when a special electrical circuit is interrupted. The sense loop primarily utilizes the conductive sense layer 12 and sense loop circuitry that is carried on the PCB 44 as part of the electronics assembly 45. The sense loop circuitry makes use of a pair of spring-loaded contacts 72, perhaps best shown in FIG. 12, extending downward from the PCB 44. These contacts 72 are connected to opposing nodes in the circuitry on the PCB 44. A preferred contact is shown in FIG. 13, which is an enlarged side view of one of the contacts 72 of FIG. 12, shown in isolation, but it will be appreciated that suitable contacts may take on many forms. Each contact 72 includes a base 74 and a spring arm 75 having a contact surface 76. As shown in FIGS. 8 and 9, the contact surfaces 76 extend through, or are at least accessible via, openings 78 in the bottom of the lower housing 43. The openings 78 in the lower housing 43 are aligned with the electric sense loop openings 38 in the edge cleat 20.

Figure 14:
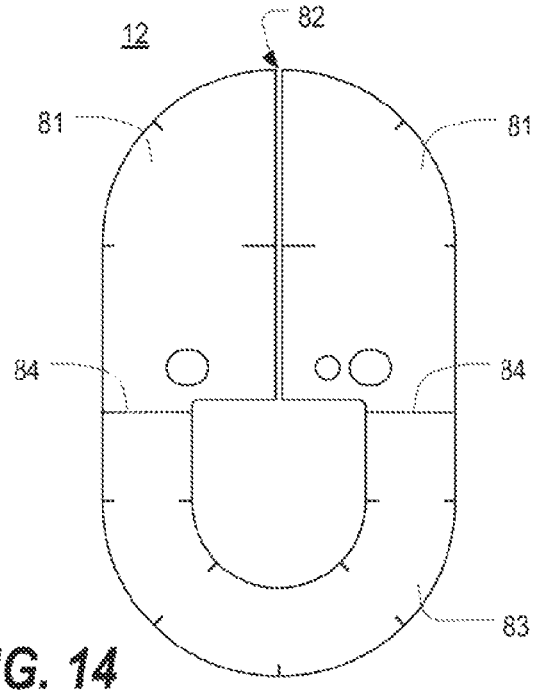
FIG. 14 is a top view of the exemplary conductive sense layer of FIG. 3, shown in a flat configuration.
Figure 15:
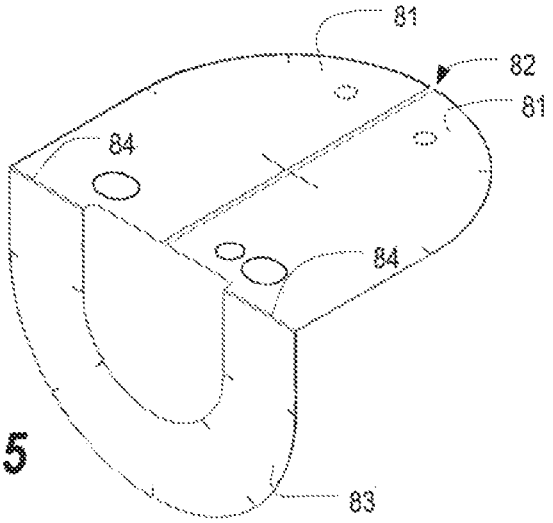
FIG. 15 is a top isometric view of the exemplary conductive sense layer of FIG. 3, shown in a folded configuration such as might be used around the openable edge of a rectilinear box.

The conductive sense layer 12 may be made, for example, of a conductive ink, a layer of aluminum foil, or other relatively low-profile (generally thin and flat) conductive material. FIG. 14 is a top view of the exemplary conductive sense layer 12 of FIG. 3, shown in a flat configuration, while FIG. 15 is a top isometric view of the exemplary conductive sense layer 12 of FIG. 3, shown in a folded configuration such as might be used around the openable edge 104 of a rectilinear box 102. As shown therein, the exemplary conductive sense layer 12 includes two primary lobes 81 separated by a gap 82. A connector strip 83 extends from the proximal end of each lobe 81 to provide an electrical connection from one lobe 81 to the other. The lobes 81 are adapted to be placed on one face 106 of a box 102, while the connector strip 83 is adapted to be creased along a fold line 84 such that the connector strip 83 may be placed against an adjoining face 107 of the box 102. In at least some embodiments, the lobes 81 and connector strip 83 are affixed to the respective box faces 106,107 such that they may not be easily removed, thereby creating a seal over the openable edge 104.

Figure 16:
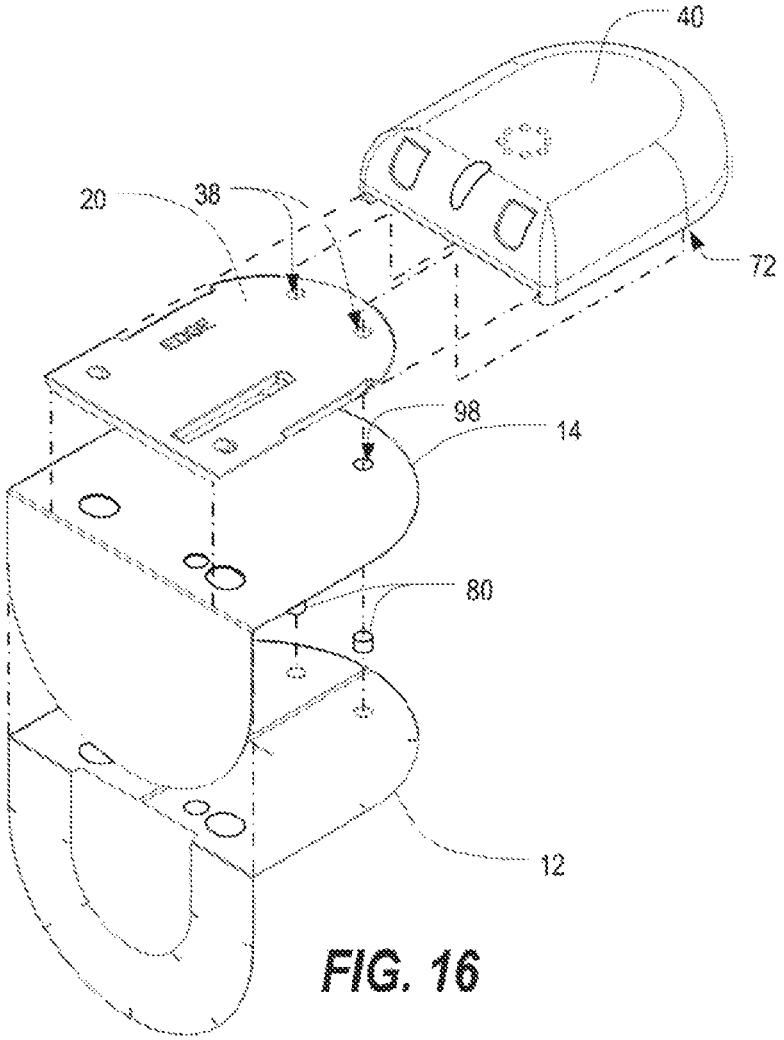
FIG. 16 is another exploded isometric view of the merchandise item and box edge security device of FIG. 2, illustrating the electrical connections between the tag assembly and the conductive sense layer.

The conductive sense layer 12 is used to complete a conductive loop between the two tag assembly contacts 72. As illustrated in FIG. 16, when the tag assembly 40 is installed on the edge cleat 20, and the edge cleat 20 is installed on the conductive sense layer 12, an electrical connection is established between the contacts 72 and the lobes 81 of the conductive sense layer 12. The electrical connection may be direct (not illustrated), wherein the contacts 72 are placed in direct physical contact through the electric sense loop openings 38 with the conductive sense layer 12, or such connection may be indirect, where intermediate electrically-connective structures are interposed between the contacts 72 and the conductive sense layer 12. In the embodiment illustrated herein, floating, electrically-connective cylinders 80 are disposed within the electric sense loop openings 38 such that their upper ends are electrically connected to the contacts 72 and their lower ends are electrically connected to the lobes 81 of the conductive sense layer 12.

Regardless of the means of connection, an electrical sense loop circuit is created when tag assembly 40 and edge cleat 20 are installed and the contacts 72 are successfully connected to the conductive sense layer 12. Because the lobes 81 and connector strip 83 are an integral portion of the sense loop circuit, it is thus clear that the integrity of the circuit depends both on the integrity of the conductive sense layer 12 and on the tag assembly 40 and edge cleat 20 remaining mounted thereon. When the sense loop is armed, removing the tag assembly, severing some portion of the conductive sense layer 12, or the like preferably triggers an alarm state. Thus, if the lobes 81 are affixed to the first face 106 and the connector strip 83 is affixed to the second face 107, any attempt by an unauthorized user to open the openable edge 104 is likely to damage the integrity of the conductive sense layer 12 (for example, by severing the connector strip 83 from one or both lobes 81) and thereby trigger an alarm state. Similarly, an attempt by an unauthorized user to remove the tag assembly 40 from the conductive sense layer 12 would likewise trigger an alarm state.

Figure 17:
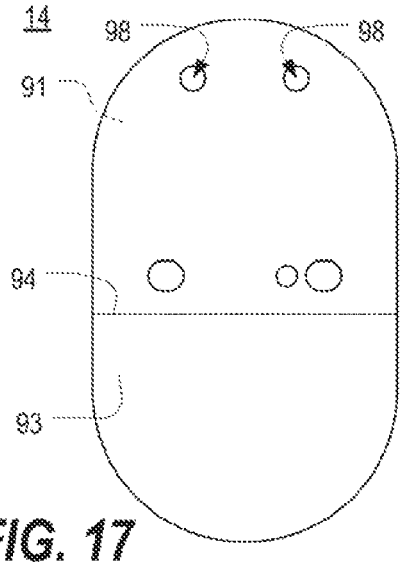
FIG. 17 is a top view of the exemplary protective layer of FIG. 3, shown in a flat configuration.
Figure 18:
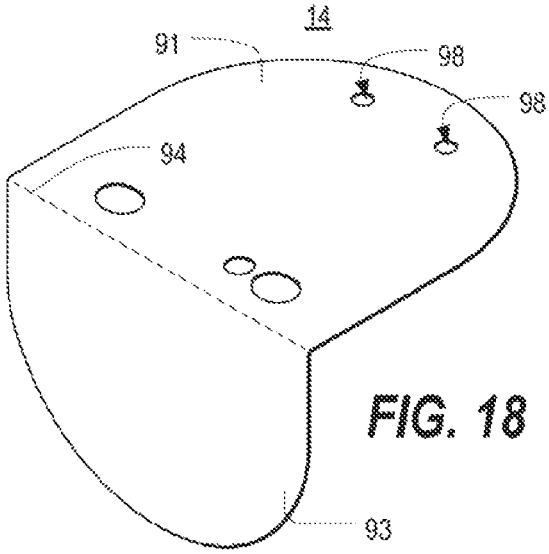
FIG. 18 is a top isometric view of the exemplary protective layer of FIG. 3, shown in a folded configuration such as might be used around the openable edge of a rectilinear box.

FIGS. 3 and 16 also illustrate the use of a protective layer 14 over the conductive sense layer 12. In this regard, FIG. 17 is a top view of the exemplary protective layer 14 of FIG. 3, shown in a flat configuration, while FIG. 18 is a top isometric view of the exemplary protective layer 14 of FIG. 3, shown in a folded configuration such as might be used around the openable edge 104 of a rectilinear box 102. The protective layer 14 may help preserve the integrity of the conductive sense layer 12 by preventing abrasion, cuts, and other damage from physical contact; by preventing damage from water and other liquids; by preventing accidental contact between conductive portions of the conductive sense layer 12 and other metallic and/or conductive materials; and/or by preventing other damage. In some embodiments, the protective layer 14 is provided as a thin film that may be creased along a fold line 94 and applied over the conductive layer 12 with a first portion 91 covering the portion of the conductive sense layer lobes 81 on the first face 106 of the box 102, and a second portion 93 covering the portion of the conductive sense layer 12 on the second face 107 of the box 102. When employed, the protective layer 14 preferably includes a pair of sense loop openings 98 to enable the contacts 72 or electrically-connective cylinders 80 to extend therethrough. In at least some embodiments, the protective layer 14 is made of PET film. The edge cleat 20 is well-suited to be attached to the edge of a merchandise box 102 such that the planar body 22 of the cleat 20 and the primary lobes 81 of the conductive sense layer 12 (as well as the first portion 91 of the protective layer 14) are placed against one face 106 of the box 102 and the connector strip 83 of the conductive sense layer 12 (as well as the second portion 93 of the protective layer 14) is placed against an adjoining face 107 of the box 102. More particularly, the assembly may be attached to the box 102 by affixing the primary lobes 81 and connector strip 83 of the conductive sense layer 12 to the adjacent faces 106,107. Attachment may be accomplished, for example, using a pressure-sensitive adhesive (PSA) applied to the underside surfaces of the conductive sense layer 12, portions of the faces 106,107 of the box 102, or both. By selecting faces 106,107 on either side of an openable edge 104 of the box 102, such edge 104, which would otherwise be openable using conventional methods, becomes sealed against such opening. More particularly, the openable edge 104 may not be opened without compromising the integrity of the box 102, the conductive sense layer 12, or both. However, it will be appreciated that the cleat 20, conductive sense layer 12, and/or protective layer 14 are not required to be placed along an edge; either or both of the conductive sense layer 12 and protective layer 14 may be laid flat along a surface of the box 102.

In at least some embodiments, the tag assembly 40 preferably also includes a box proximity sensor 56 for use in causing the alarm system to enter an alarm state and thereby generate one or more alarms. In at least some embodiments, the box proximity sensor 56 is simply a contact sensor comprising a spring-loaded or otherwise biased plunger 57 that extends from the bottom of the lower housing 43. The plunger 57 is situated such that when the tag assembly 40 is properly installed on the edge cleat 20, the plunger 57 extends all the way through the box sensor aperture 36 in the edge cleat 20. Thus, when the device 10 is installed on the box 102, the end of the plunger 57 comes into contact with a surface of the box 102 and is pressed inward into the lower housing 43, triggering a switch 58 that arms a portion of the alarm system. The plunger 57 is held in such depressed state, and thus the switch 58 remains triggered, so long as the device 10 remains in place on the box 102. If the device 10 is subsequently removed from the box 102 (or if the tag assembly 40 is removed from the edge cleat 20) without first disarming the corresponding portion of the alarm system, then the plunger 57 is forced outward by the spring or other biasing element, thereby releasing the switch 58 and triggering an alarm. In at least some embodiments, disarming the alarm system may be accomplished using a specifically configured key, such as a magnetic key or a coded electronic key.

In at least some embodiments, the box sensor aperture 36 is arranged in the form of a slot that is parallel to the direction of lateral translation between the tag assembly 40 and the edge cleat 20. The shape and orientation of the slot 36 permits the plunger 57 to extend through and beyond the bottom of the edge cleat 20 during such lateral translation. In at least some of these embodiments, the plunger 57 is protected by a pair of bosses 59 extending from the bottom of the lower housing 43 of the tag assembly, with one boss 59 being disposed on either side of the plunger 57 and arranged to extend into the slot 36.

In at least some embodiments, the alarm system is armed only when the tag assembly 40 is properly installed on the edge cleat 20. In other words, the tag assembly 40 being installed on the edge cleat 20 may serve as a first condition for the alarm system being armed. This may be accomplished, for example, using the contacts 72 on the bottom of the tag assembly 40. Referring again to FIGS. 12 and 13, the distal end of the spring arm 75 of each contact 72 includes an additional contact surface 77, and a corresponding pad 79 is provided for each spring arm 75 on the bottom of the PCB 44. The additional contact surfaces 77 and pads 79 are linked via circuitry (not illustrated) to the alarm system such that the alarm system is armed only if the each contact surface is in electrical contact with its respective pad 79. The contact surfaces 77 are forced into contact with the pads 79 when the tag assembly 40 is seated on the edge cleat 20. Thus, the first condition for the alarm system being armed is normally met so long as the tag assembly 40 is seated on the edge cleat 20.

Figure 19:
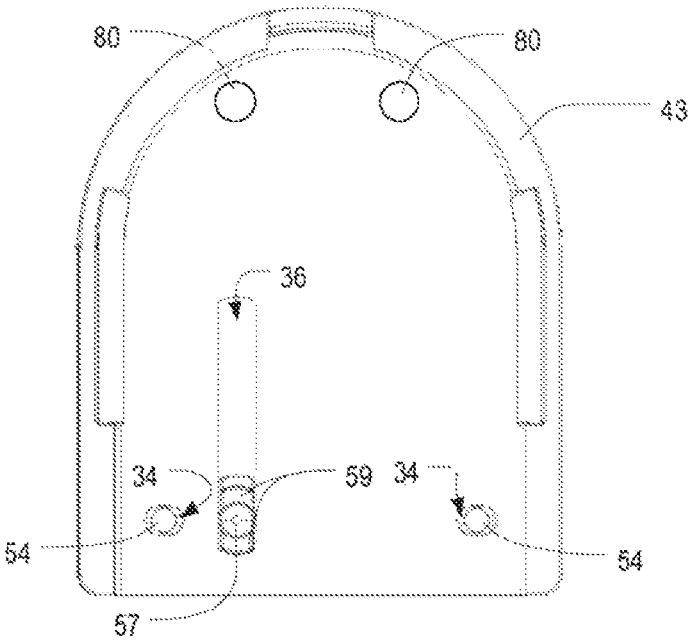
FIG. 19 is a bottom view of the tag assembly (including electrical connectors) and edge cleat of FIG. 2, shown in isolation.

The security device 10 preferably also includes one or more features for ensuring that the tag assembly 40 remains seated on the edge cleat 20 while in use. For example, as shown in FIG. 8, the tag assembly 40 may include one or more lock plugs 54 to help prevent the removal of the tag assembly 40 from the edge cleat 20. More particularly, in at least some embodiments, each lock plug 54 comprises a spring-loaded or otherwise biased pin that is movable between an engaged position and a disengaged position. In the engaged position, the lock plugs 54 are positioned to prevent the tag assembly 40 from being moved out of the coupled state, i.e., removed from the edge cleat 20. In the illustrated embodiment, the lock plugs 54 protrude from the bottom of the lower housing 43, as perhaps best shown in FIG. 8, and extend into the lock apertures 34, which as shown in FIG. 19 are aligned therewith. In the disengaged position, the lock plugs 54 are retracted or are otherwise positioned such that they do not interfere with the movement of the tag assembly 40 from the coupled state to a removed state. The lock plugs 54 thus impact whether or not the tag assembly 40 may be moved laterally (slid) off of the edge cleat 20. The security device 10 is preferably configured such that the lock plugs 54 are biased toward their engaged positions. Moreover, with the tag assembly 40 in the coupled state, the security device 10 may further be configured to prevent the lock plugs 54 from being moved from their engaged positions without a specifically configured key. The key may be a magnetic key, coded electronic key, or other conventional key.

Figure 20:
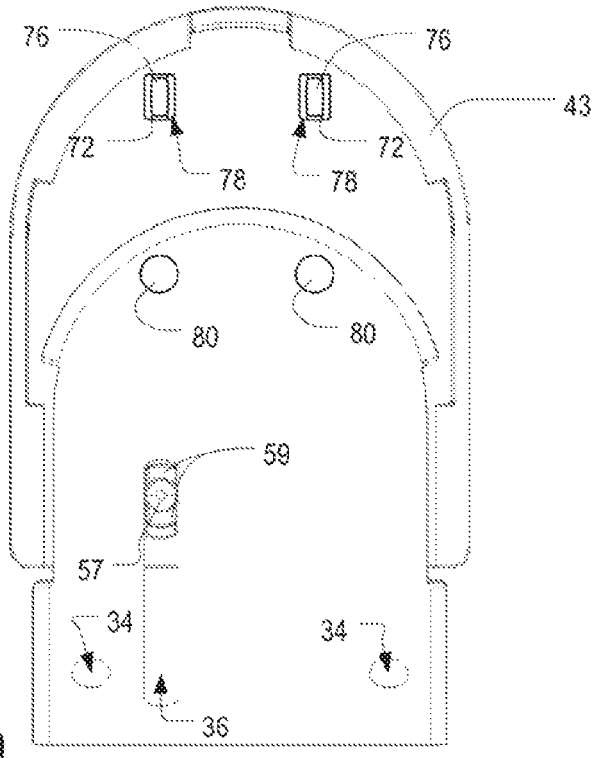
FIG. 20 is a bottom view of the tag assembly and edge cleat of FIG. 19, shown with the tag assembly and edge cleat in a laterally-translated configuration such that the tag assembly may be lifted from the edge cleat.

In order to assemble the tag assembly 40 to the edge cleat 20, the spring-loaded pins of the lock plugs 54 are disengaged from the edge cleat 20 and retracted into the tag assembly 40. The tag assembly 40 may then be laterally translated relative to the edge cleat 20, as shown in FIG. 20. Notably, the plunger 57 and its protective bosses 59 continue to extend from the bottom of the tag assembly 40 but are free to translate within the slot 36 in the edge cleat 20. Meanwhile, portions of the tag assembly interface 32 and the cleat interface 52 remain interlocked during such lateral translation until the plunger 57 and bosses 59 near the end of the slot 36, at which point discontinuities in the interfaces 32,52 free one interface from the other, permitting vertical translation between the tag assembly 40 and the edge cleat 20. In other words, when the tag assembly 40 has been moved to the configuration shown in FIG. 20, relative to the edge cleat 20, the tag assembly 40 may be lifted off of the edge cleat 20 and removed completely.

In embodiments using the sense loop, box proximity sensor, and arming circuitry described above, operation of the alarm system may be conditioned on the arming of thereof through contact between the contact surfaces 77 of the spring-loaded contacts 72 and their respective pads 79 on the bottom of the PCB 44. With the alarm system armed, either or both of 1) a break in the sense loop (for example, if the tag assembly 40 is removed, or if some portion of the conductive sense layer 12 is severed) or 2) a release of the switch 58 in the box proximity sensor 56 causes the alarm system to enter an alarm state and thereby generate one or more alarms using an audio alarm, visual alarm, or the like, as described elsewhere herein. It will be appreciated, however, that in various alternative embodiments, some of which are described and/or illustrated herein, one or more of the sense loop, box proximity sensor, and arming circuitry may be omitted with departing from the scope of the present invention.

The alarm system may additionally or alternatively be configured to enter an alarm state, and thus activate the alarm, depending on the location of the EAS tag to the gates of the security system. In some embodiments, the alarm system may be integrated with the security system. In some embodiments, the alarm system may be configured to trigger an alarm once the EAS tag is near, at, or beyond the gate which should help the employees to detect the merchandise with the attached security device. Therefore, in some embodiments, the security device may have three alarm features, e.g., the gates themselves alarming when the EAS tag is detected, an alarm (e.g. audio, visual, or the like) of the security device 10 itself triggering when the device 10 is compromised or otherwise tampered with, and an alarm of the security device 10 triggering when the EAS tag is at, near, or beyond the security gates.

Figure 21:
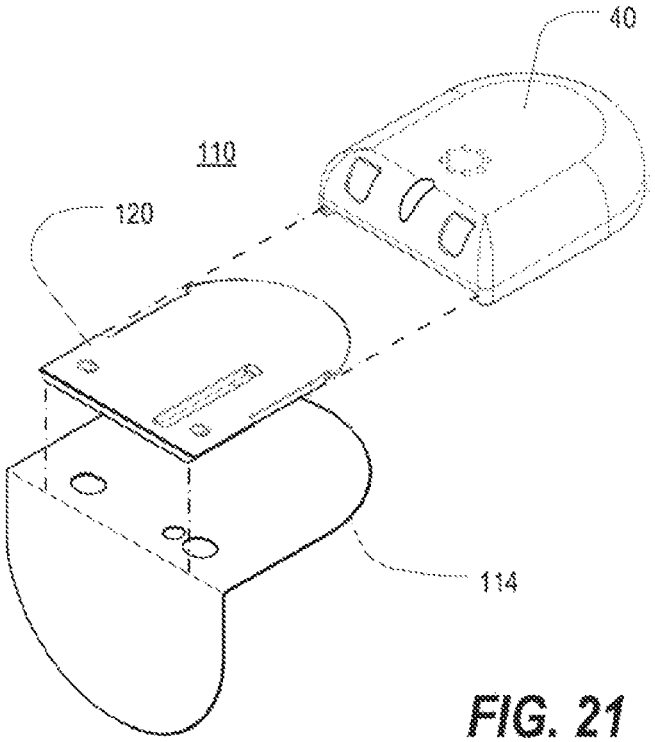
FIG. 21 is an exploded isometric view of an alternative box edge security device.

FIG. 21 is an exploded isometric view of an alternative box edge security device 110 in accordance with one or more further preferred embodiments of the present invention. Such a device 110 may be used in like manner to the device 10 of FIG. 1, wherein the device is placed along an openable edge 104 of a merchandise box 102. The device 110 of FIG. 21 includes an edge cleat 120, a protective layer 114, and a tag assembly 40, but no conductive sense layer.

Figure 22:
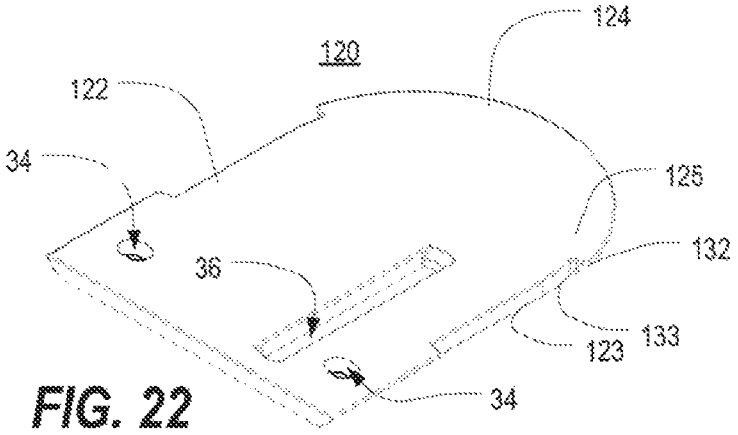
FIG. 22 is a top isometric view of the edge cleat of FIG. 21.

The edge cleat 120 and protective layer 114 are very similar to the edge cleat 20 of FIG. 4 and the protective layer 14 of FIG. 18. In this regard, FIG. 22 is a top isometric view of the edge cleat 120 of FIG. 21. As shown therein, the edge cleat 120 includes a planar body 122 whose underside surface is generally flat, and also includes one or more lock apertures 34 and a box sensor opening 36. However, because the security device 200 includes no conductive sense layer, there is no need for the respective electric sense loop openings 38,98 in the edge cleat 120 and protective layer 114, respectively.

Figure 23:
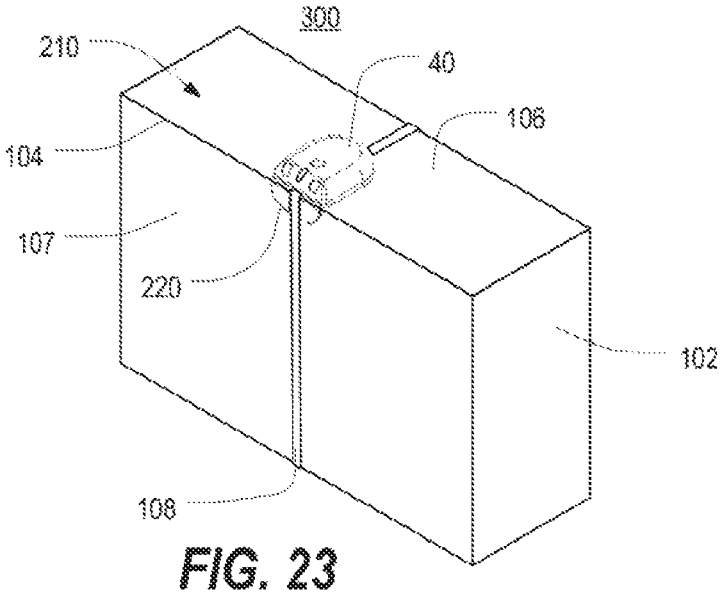
FIG. 23 is an orthogonal view of a merchandise item protected by another alternative box edge security device.

The tag assembly 40 may be identical to that of FIGS. 1-3, so long as the sense loop circuitry in that tag assembly 40 may be deactivated. The alarm system is preferably armed when the tag assembly 40 is seated on the edge cleat 120, and an alarm state is entered (thereby triggering an alarm) when the box proximity sensor 56 is removed from the box 102, thereby releasing the switch 58. The alarm system may additionally or alternatively be configured to enter an alarm state, and thus activate an alarm, based on the location of the EAS tag to the gates of the EAS security system. FIG. 23 is an orthogonal view of a merchandise item 300 protected by another alternative box edge security device 210 in accordance with one or more further preferred embodiments of the present invention. As shown therein, the merchandise item 300 is packaged in a box 102, having an openable edge 104, and around which is wrapped a strap, band, or the like 108 (hereinafter referred to as a "strap"). It will be appreciated that although only a single strap 108 is shown in FIG. 23, any number of straps 108 may be utilized according to the preference of the merchandise item manufacturer, packer, shipper, retailer, or the like.

Figure 24:
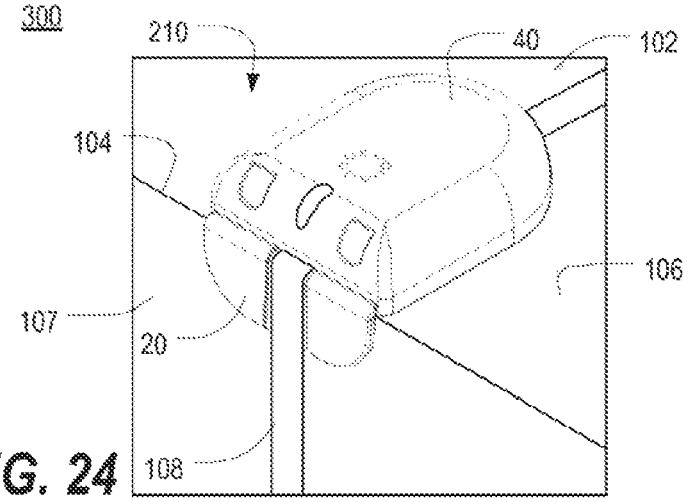
FIG. 24 is an enlarged isometric view of the merchandise item and box edge security device of FIG. 23.
Figure 25:
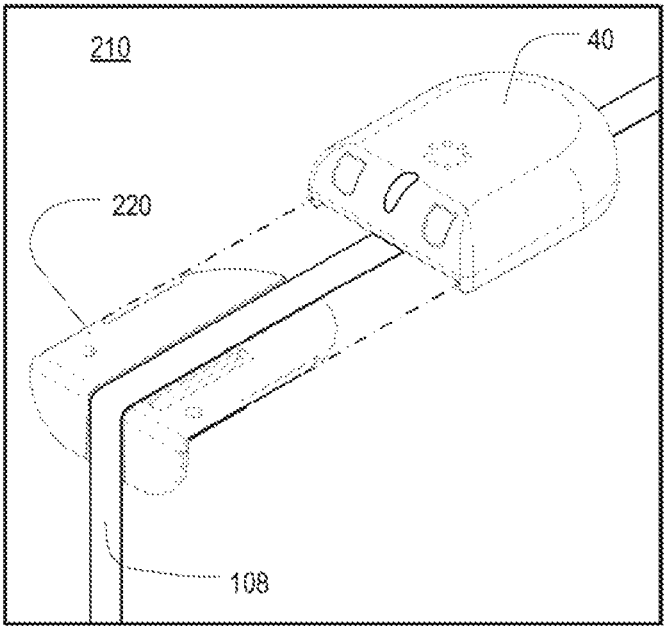
FIG. 25 is an exploded isometric view of the merchandise item and box edge security device of FIG. 24.

In the arrangement of FIG. 23, the strap 108 is not provided as part of the box 102, but as part of the security device 210. In this regard, FIG. 24 is an enlarged isometric view of the merchandise item 300 and box edge security device 210 of FIG. 23, and FIG. 25 is an exploded isometric view of the merchandise item 300 and box edge security device 210 of FIG. 24. As shown therein, the box edge security device 210 includes an edge cleat 220, a tag assembly 40, and the strap 108.

Figure 26:
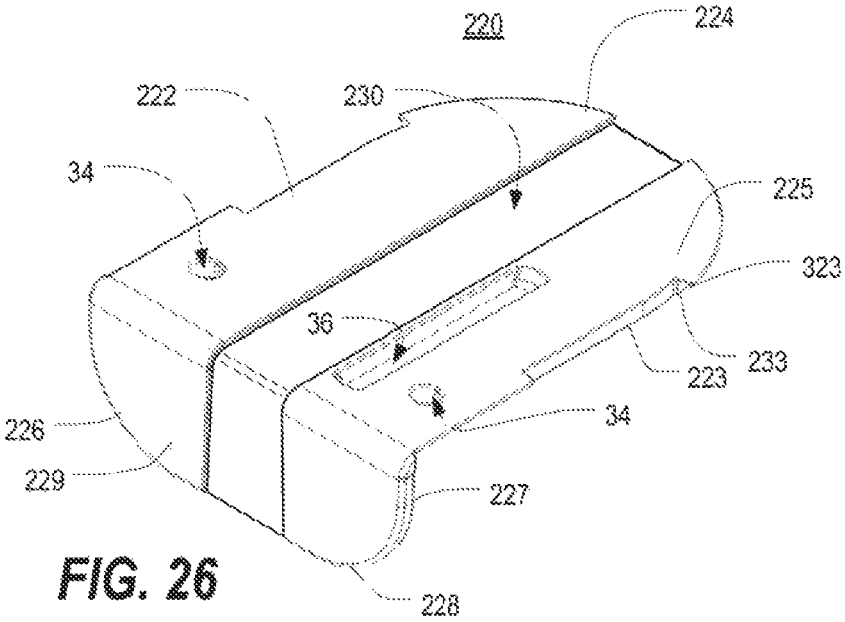
FIG. 26 is a top isometric view of the edge cleat of FIG. 24.
Figure 27:
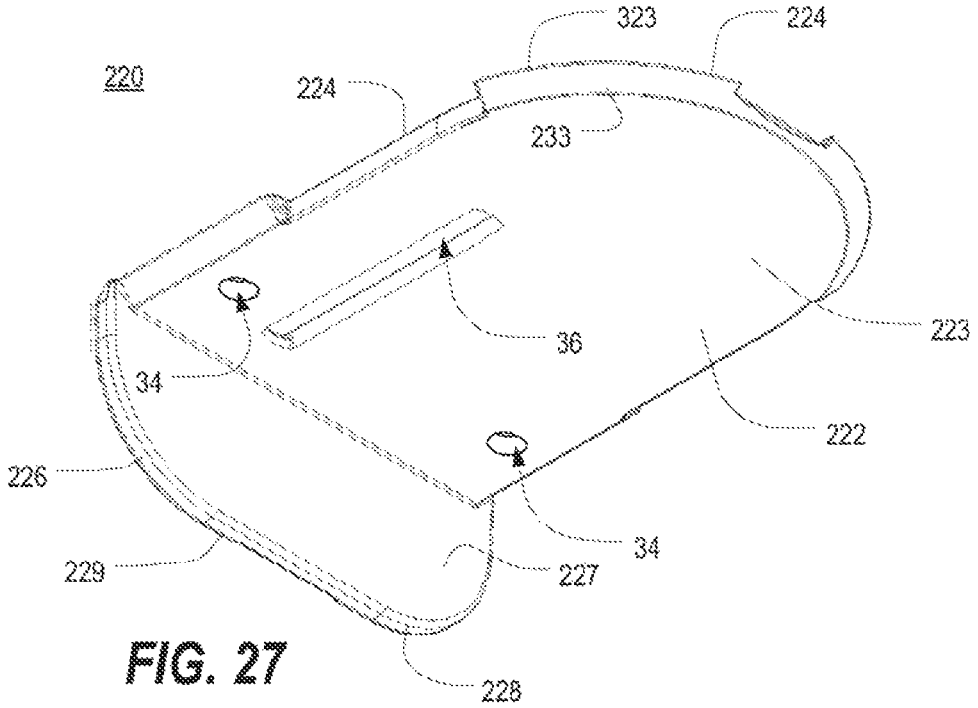
FIG. 27 is a bottom isometric view, of the edge cleat of FIG. 24.

FIGS. 26 and 27 are a top isometric view and a bottom isometric view, respectively, of the edge cleat 220 of FIG. 24. As shown therein, the edge cleat 220 includes a first portion 222 and a second portion 226 whose underside surfaces 223,227 are generally flat and are arranged at angles to each other. In most embodiments, the first and second underside surfaces 223,227 may be oriented at right angles to each other so as to fit around the openable edge of a box whose adjacent faces meet at right angles to each other, but the first and second underside surfaces 223,227 may be oriented at other angles relative to one another, particularly for specialized boxes whose adjacent faces meet at such other angles. The first and second portions 222,226 are formed or otherwise manufactured integrally, preferably via injection molding or the like, and the joint between them is strong and durable enough to resist being broken, torn, or otherwise separated by hand. The edge cleat 220 is preferably made of plastics, such as polyethylene terephthalate (PET) or ABS. In at least one contemplated commercial embodiment, the first portion 222 is approximately 2 mm thick around its periphery but includes thicker areas (as described below), and the second portion 226 is approximately 1 to 2 mm thick.

Figure 28:
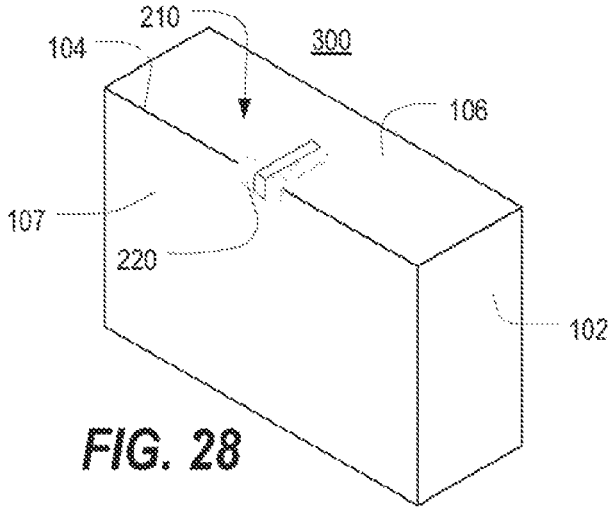
FIG. 28 is an orthogonal view of the merchandise item of FIG. 23 showing the edge cleat installed thereon.

The edge cleat 220 is well-suited to be attached to the edge of a merchandise box 102 such that the first portion 222 of the cleat 220 is placed against one face 106 of the box 102 and the second portion 226 of the cleat 220 is placed against an adjoining face 107 of the box 102. Unlike the edge cleat 20 of FIG. 4, this edge cleat 220 may be attached to the box 102 via the strap 108. In this regard, FIG. 28 is an orthogonal view of the merchandise item 300 of FIG. 23 showing the edge cleat 220 installed thereon. In order to facilitate attachment via the strap 108, the outer surface 225 of the first portion 222 includes a flat, shallow channel 230 extending from the proximal end (where the first portion 222 joins the second portion 226) to the distal end thereof. The channel 230 is preferably slightly wider and deeper than the width and depth, respectively, of the strap 108 with which the cleat 220 is to be used, but it will be appreciated that smaller straps 108 may be utilized without changing the dimensions of the channel 230. One function of the channel 230 is to allow the tag assembly 40 to be coupled to the edge cleat 220, with the strap 108 imprisoned in between, without interference from the strap 108. However, it will be appreciated that the strap 108 may be thin enough that any interference it causes is minimal. Furthermore, a channel or other features may additionally or alternatively be incorporated into the tag assembly 40. For example, as perhaps best shown in FIG. 8, a notch 61 may be provided in the rear edge thereof. Other notches, channels, and similar structures may be provided in the tag assembly 40, the PCB 44, and the like.

The first portion 222 of the edge cleat 220 further includes a tag assembly interface 232, one or more lock apertures 34, and a box sensor aperture 36. In the illustrated embodiment, the tag assembly interface 232 includes one or more profiled edges that interlock with corresponding structures on the underside of the tag assembly 40. Like the profiled edges of the edge cleat 220 of FIGS. 4-6, the illustrated edges are inwardly-angled from the top/outer surface 225 to the underside surface that may be joined to corresponding surfaces on the tag assembly 40, by sliding the tag assembly 40 onto the edge cleat 220, to form a secure joint. However, other angled joints, tongue and groove joints, and the like may additionally or alternatively be utilized.

In the illustrated embodiment, there are two lock apertures 34. The lock apertures 34 and box sensor aperture 36 are arranged to engage corresponding structures or elements on the tag assembly 40. Their use and operation are similar to that of the lock apertures 34 and box sensor aperture 36 of the edge cleat 20 of FIGS. 1-3. Also like the previous edge cleat 20, the planar body 222 of the edge cleat of FIGS. 26 and 27 is formed or otherwise manufactured integrally, preferably via injection molding or the like. Like the other cleats described herein, the edge cleat 220 is preferably made of plastics, such as PET or ABS. In at least one contemplated commercial embodiment, the planar body 222 has a thickness.

In at least some embodiments, the cleat 220 is held in place on an edge 104 of the box 102 by the tension of the strap 108 around the box and/or by virtue of being clamped around the strap 108. However, the cleat 220 may be additionally or alternatively attached to the box 102 by affixing the first and second portions 222,226 of the cleat 220 to the adjacent faces 106,107. This may be accomplished, for example, using a pressure-sensitive adhesive (PSA) applied to the underside surfaces 223,227 of the cleat, portions of the faces 106,107 of the box 102, or both. By selecting faces 106,107 on either side of an openable edge 104 of the box 102, such edge 104, which would otherwise be openable using conventional methods, becomes sealed against such opening. More particularly, the openable edge 104 may not be opened without compromising the integrity of the box 102, the edge cleat 220, or both.

In at least some embodiments, the distal ends 224,228 of the first and second cleat portions 222,226 are curved so as to avoid corners that might be more easily pried from the box 102 and/or for some other purpose. However, the curvature may vary from that shown in the drawings, and in some embodiments, shapes having vertices may be employed, particularly if their angles are relatively wide (and thus not sharp).

Except for the areas of the first portion 222 that interact with the tag assembly 40, the contours of the outer surfaces 225,229 of the first and second cleat portions 222,226 may be somewhat less important than the underside surfaces 223,227 in the sense that they need not been flat, but in at least some embodiments the outer surfaces 225,229 are also flat for the purpose of manufacturing ease and/or some other purpose.

The tag assembly 40 may once again be identical to that of FIGS. 1-3, so long as the sense loop circuitry in that tag assembly 40 may be deactivated. The alarm system is preferably armed when the tag assembly 40 is seated on the edge cleat 220, and an alarm state is entered (thereby triggering an alarm) when the box proximity sensor 56 is removed from the box 102, thereby releasing the switch 58. The alarm system may additionally or alternatively be configured to enter an alarm state, and thus activate an alarm, based on the location of the EAS tag to the gates of the EAS security system.

Figure 29:
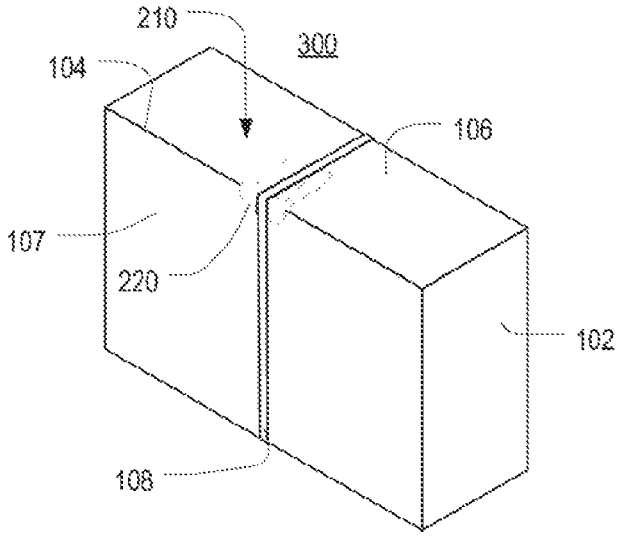
FIG. 29 is an orthogonal view of the merchandise item of FIG. 23 showing the edge cleat and strap installed thereon.

Although in some cases the strap 108 may be installed around the box 102 prior to placement of the edge cleat 220 along the openable edge 104, it is believed to be easier, when the strap 108 is provided as part of the security device 210, to place (and attach, if desired) the edge cleat 220 first, as shown in FIG. 28. The strap 108 may then be wrapped around the box 102, as shown in FIG. 29, and properly tensioned. This approach avoids the need to maneuver the edge cleat 220 beneath an already-installed (and potentially very tight) strap 108. However, it may also be possible to attach the strap 108 first and then maneuver the edge cleat 220 beneath it.

Figure 30:
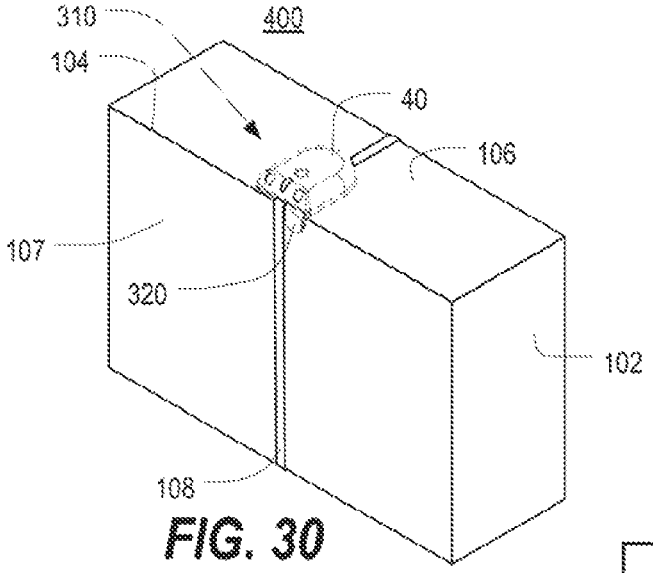
FIG. 30 is an orthogonal view of a merchandise item protected by another alternative box edge security device.

FIG. 30 is an orthogonal view of a merchandise item 400 protected by another alternative box edge security device 310 in accordance with one or more further preferred embodiments of the present invention. Like the merchandise item 300 of FIG. 23, the merchandise item of FIG. 30 is packaged in a box 102, having an openable edge 104, and around which is wrapped a strap 108. However, the arrangement of FIG. 30 is believed to be particularly useful in situations where the strap 108 is installed around the box 102 prior to application of the security device 310.

Figure 31:
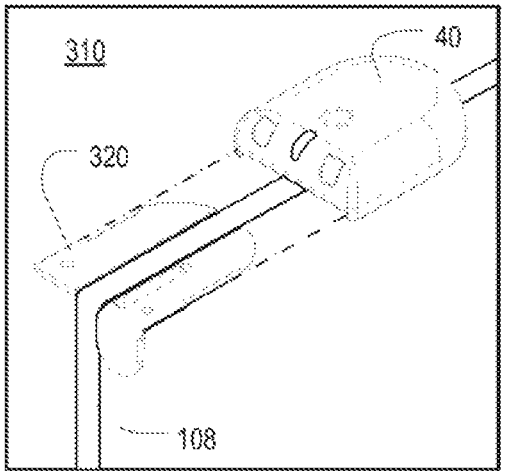
FIG. 31 is an exploded isometric view of the merchandise item and box edge security device of FIG. 30.
Figure 32:
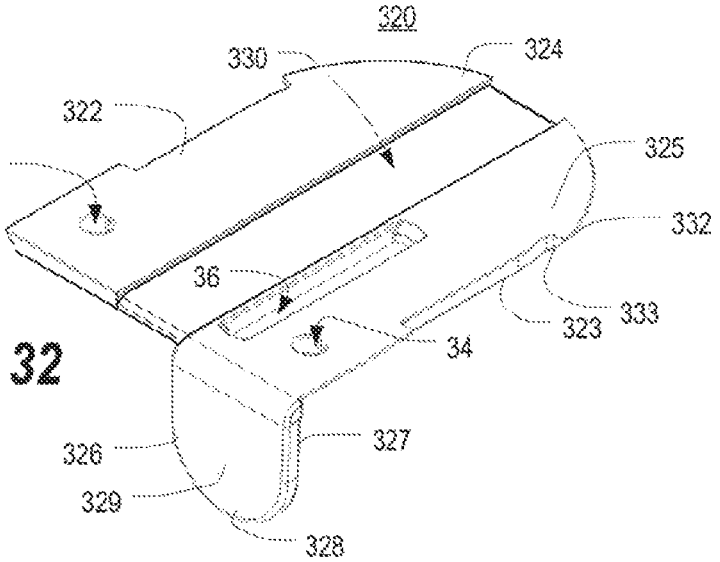
FIG. 32 is a top isometric view of the edge cleat of FIG. 31.
Figure 33:
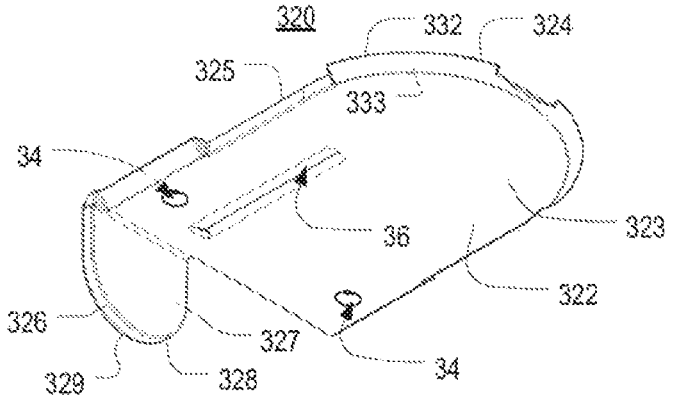
FIG. 33 is a bottom isometric view of the edge cleat of FIG. 31.

FIG. 31 is an exploded isometric view of the merchandise item 400 and box edge security device 310 of FIG. 30, while FIGS. 32 and 33 are a top isometric view and a bottom isometric view, respectively, of the edge cleat 320 of FIG. 31. As shown in FIG. 31, the box edge security device 310 includes an edge cleat 320 and a tag assembly 40 that accommodate the strap 108. As with the edge cleat 220 of FIGS. 25-27, the edge cleat 320 of FIGS. 31-33 includes a first portion 322 and a second portion 326 whose underside surfaces 323,327 are generally flat and are arranged at angles to each other. In at least some embodiments, the distal ends 324,328 of the first and second cleat portions 322,326 are curved so as to avoid corners that might be more easily pried from the box 102 and/or for some other purpose. The two edge cleats 320,220 are very similar, but the second portion 326 of the edge cleat 320 of FIGS. 31-33 extends along only a portion of a front edge of the first portion 322. Thus, unlike the second cleat portion 226 of the previous cleat 220, the second portion 326 of the cleat 320 of FIGS. 31-33 is not arranged to fit underneath the strap 108. However, attachment via the strap 108 is still possible because the outer surface 325 of the first portion 322 includes a flat, shallow channel 330 similar to the channel 230 of the previous cleat 220.

As with prior-described cleats, this cleat 320 includes one or more lock apertures 34 and a box sensor opening 36 and supports the functionality described previously. Similarly, the tag assembly 40 may be identical to that of previous embodiments. The alarm system is preferably armed when the tag assembly 40 is seated on the edge cleat 320, and an alarm state is entered (thereby triggering an alarm) when the box proximity sensor 56 is removed from the box 102, thereby releasing the switch 58. The alarm system may additionally or alternatively be configured to enter an alarm state, and thus activate an alarm, based on the location of the EAS tag to the gates of the EAS security system.

Figure 34:
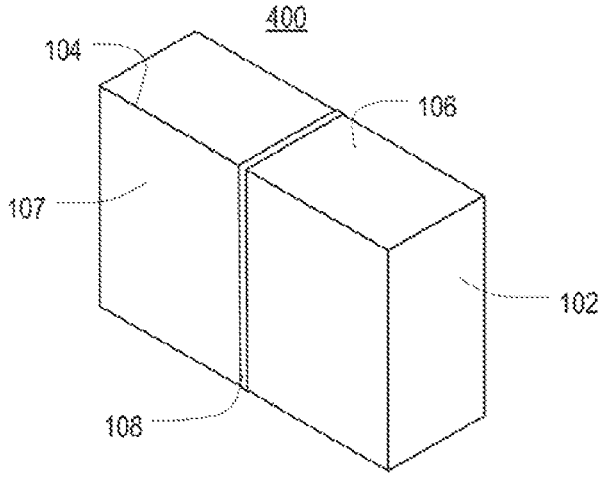
FIG. 34 is an orthogonal view of the merchandise item of FIG. 30 showing only the strap installed thereon.
Figure 35:
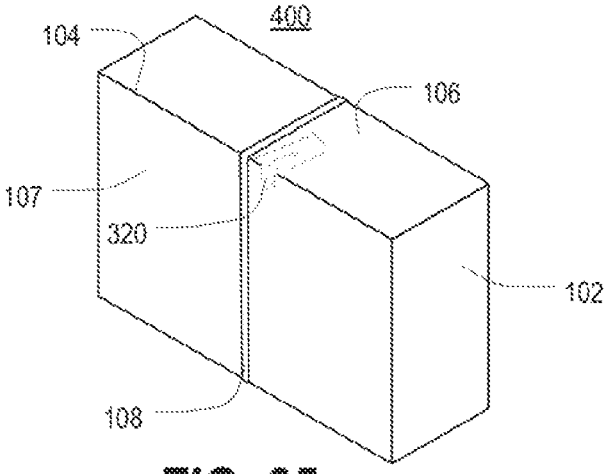
FIG. 35 is an orthogonal view of the merchandise item of FIG. 30 showing the edge cleat being installed beneath/inside the strap.
Figure 36:
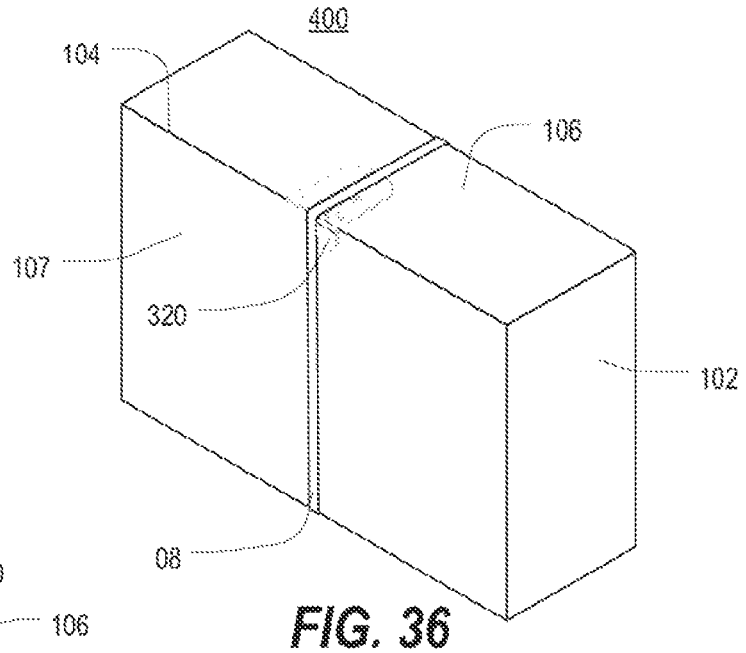
FIG. 36 is an orthogonal view of the merchandise item of FIG. 30 showing the edge cleat fully installed underneath the strap.

As with the edge cleat 220 of FIGS. 25-27, the edge cleat 320 of FIGS. 31-33 is well-suited to be attached to the edge of a merchandise box 102 such that the first portion 322 of the cleat 320 is placed against one face 106 of the box 102 and the second portion 326 of the cleat 320 is placed against an adjoining face 107 of the box 102. Unlike the edge cleat 220 of FIGS. 25-27, this edge cleat 320 may be easily attached to the box 102 after the strap 108 has already been installed. In this regard, FIG. 34 is an orthogonal view of the merchandise item 400 of FIG. 30 showing only the strap 108 installed thereon, while FIG. 35 is an orthogonal view of the merchandise item 400 of FIG. 30 showing the edge cleat 320 being installed beneath/inside the strap 108, and FIG. 36 is an orthogonal view of the merchandise item 400 of FIG. 30 showing the edge cleat 320 fully installed underneath the strap 108. As particularly suggested by FIG. 35, this edge cleat 320 is believed particularly suitable for post-strap installation because it may be more readily maneuvered beneath/inside the strap 108. However, the cleat 320 may also be placed along the openable edge 104 prior to installation of the strap 108 if desired.

Figure 37:
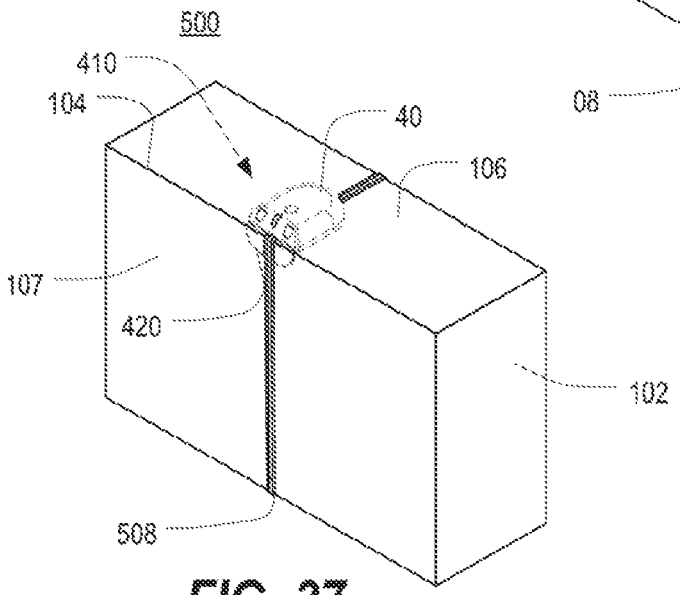
FIG. 37 is an orthogonal view of a merchandise item protected by another alternative box edge security device.
Figure 38:
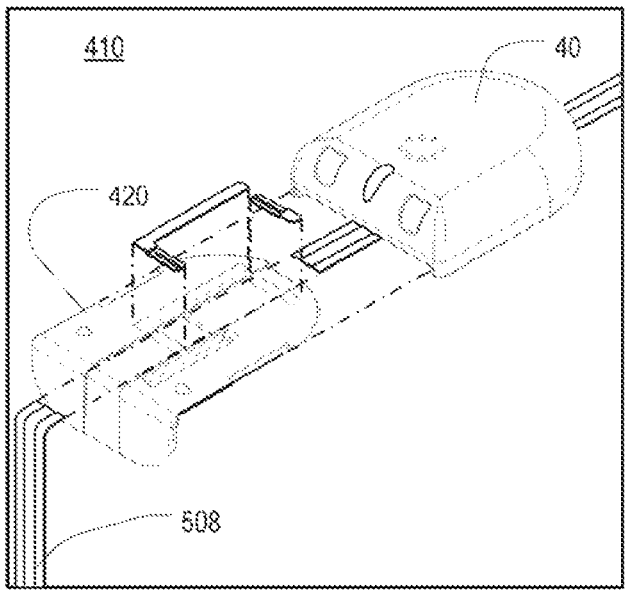
FIG. 38 is an exploded isometric view of the box edge security device of FIG. 37.

FIG. 37 is an orthogonal view of a merchandise item 400 protected by another alternative box edge security device 410 in accordance with one or more further preferred embodiments of the present invention, and FIG. 38 is an exploded isometric view of the box edge security device 410 of FIG. 37. Such a device 410 may be used in somewhat similar manner to the device 210 of FIG. 23, wherein the device is placed beneath a strap 108 along an openable edge 104 of a merchandise box 102. However, in addition to an edge cleat 420 and a tag assembly 40, this device 410 utilizes a strap 508 in the form of a length of conductive tape. The conductive tape 508 is utilized not only to physically retain the security device 410 in place, but to provide the functionality of a sense loop, as described previously with respect to the security device 10 of FIGS. 1-18.

Figure 39:
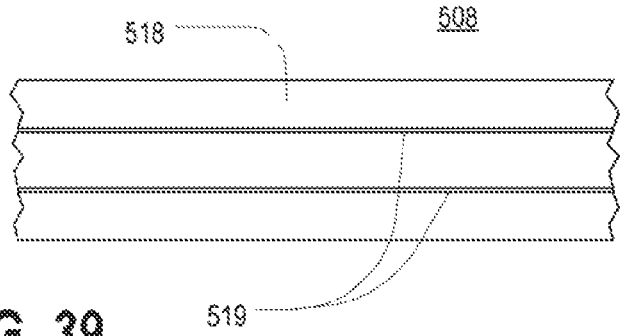
FIG. 39 is a top or front fragmentary view of the conductive tape of FIGS. 37 and 38.

FIG. 39 is a top or front fragmentary view of the conductive tape 508 of FIGS. 37 and 38. As shown therein, the conductive tape 508 includes a main web or panel 518 along which one or more conductors 519 extend. Two such conductors 519 are illustrated, but other numbers of conductors may be provided. In at least some embodiments, the main web 518 is comprised of an adhesive tape that adheres sufficiently to the merchandise box 102. However, in some embodiments, the conductive tape 508 is a panel of non-adhesive material to which an adhesive is applied to at least one side. Also in at least some embodiments, the conductors 519 are conductive wires. The wires 519 may be affixed to the surface of the main web 518, or may in some embodiments be embedded within the main web 518 and exposed only in desired locations. If affixed, an adhesive may be used that also adheres to the box 102 and edge cleat 420. In some embodiments, the conductors 519 may be replaced by a conductive adhesive.

Figure 40:
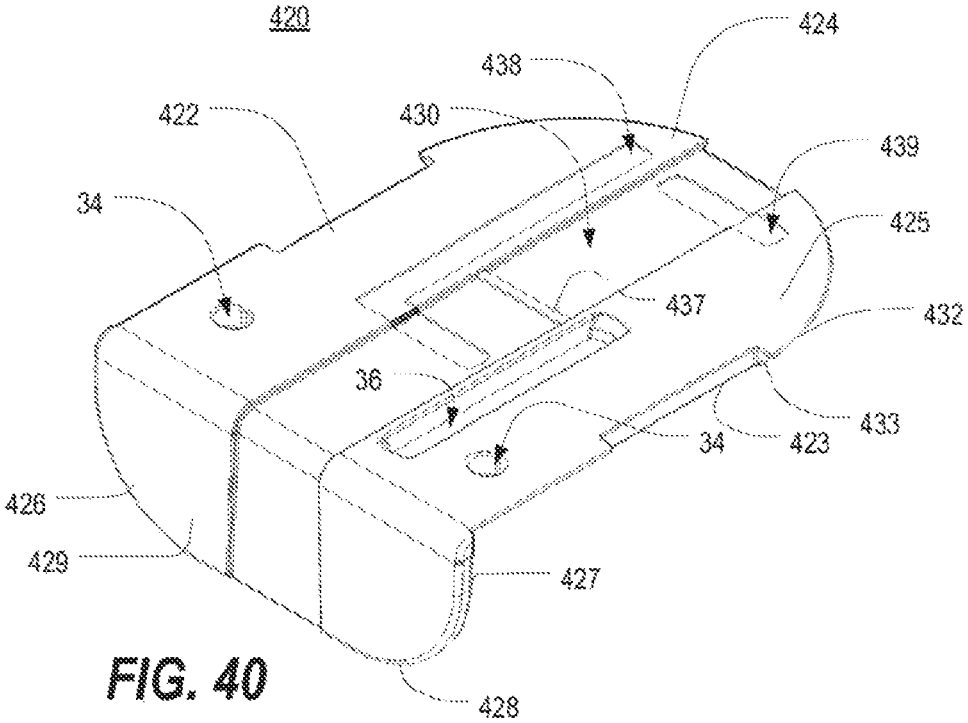
FIG. 40 is a top isometric view of the edge cleat of FIG. 38.
Figure 41:
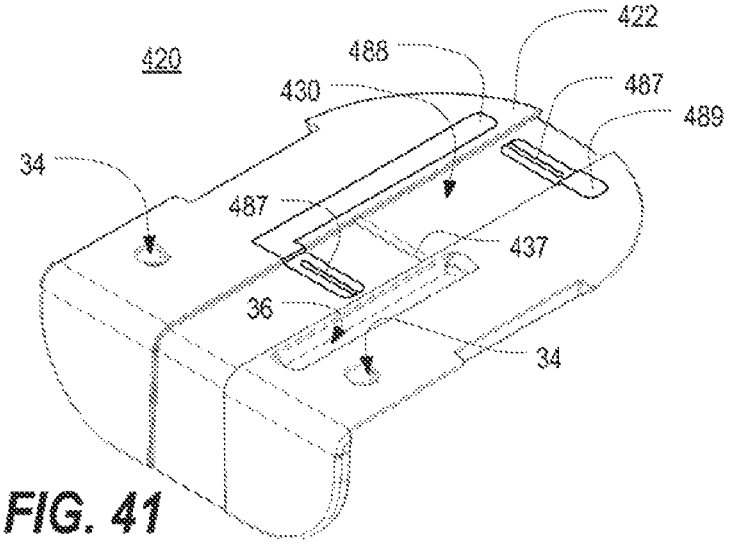
FIG. 41 is a top isometric view of the edge cleat of FIG. 38, shown with contact tabs installed therein.

FIG. 40 is a top isometric view of the edge cleat 420 of FIG. 38. As shown in FIG. 38, the box edge security device 410 includes an edge cleat 420 and a tag assembly 40 that accommodate the conductive tape 508. As with the edge cleat 220 of FIGS. 25-27, the edge cleat 420 of FIGS. 38 and 40 includes a first portion 422 and a second portion 426 whose underside surfaces 423,427 are generally flat and are arranged at angles to each other. In at least some embodiments, the distal ends 424,428 of the first and second cleat portions 422,426 are curved so as to avoid corners that might be more easily pried from the box 102 and/or for some other purpose. The two edge cleats 420,220 are very similar. Notably, the outer surface 425 of the first portion 422 includes a flat, shallow channel 430 similar to the channel 230 of the previous cleat 220. However, as perhaps best shown in FIG. 40, the top (outer) surface 425 of the edge cleat 420 includes a pair of flat recesses 438,439 that are each aligned at a first end with a respective sense loop contact 72 on the bottom of the tag assembly 40, and that extend into the shallow channel 430 at their opposite end. As shown in FIG. 41, each flat recess 438,439 carries a respective contact tab 488,489 that is arranged to make electrical contact with one of the sense loop contacts 72 at its first end and provides a conductive tape contact surface 487 at its opposite end. Also, a raised bumper wall 437 is provided in the shallow trough 430 to help prevent accidental electrical contact between portions of the conductive tape 508.

Figure 42:
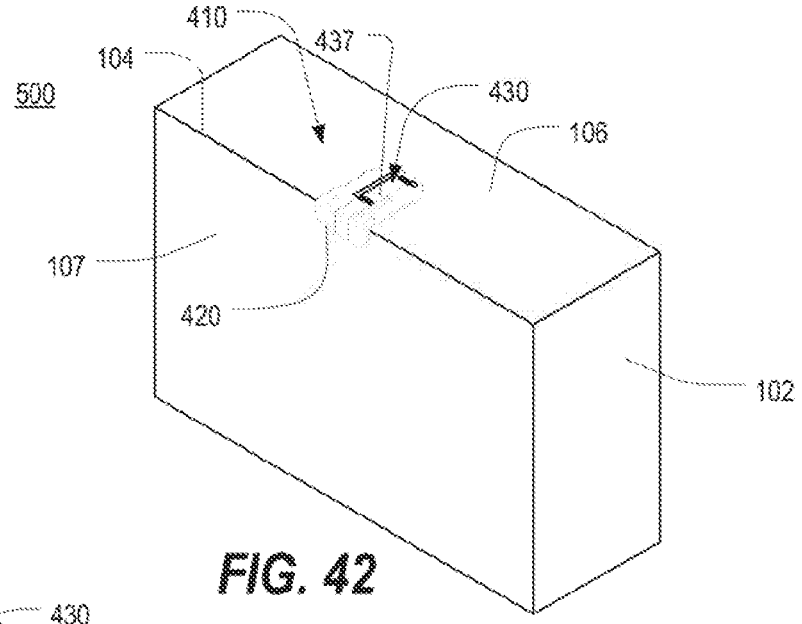
FIG. 42 is an orthogonal view of the merchandise item of FIG. 37 showing the edge cleat installed thereon.
Figure 43:
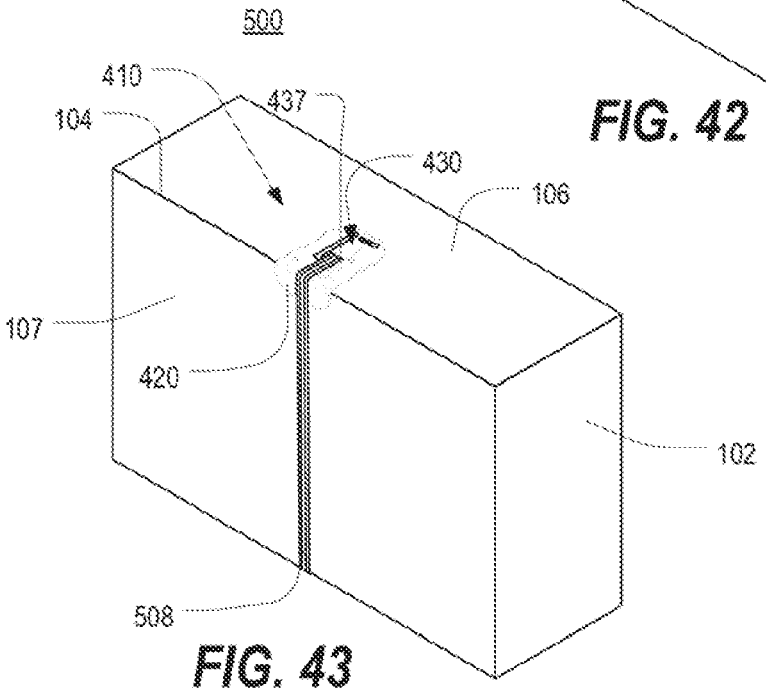
FIG. 43 is an orthogonal view of the merchandise item of FIG. 37 showing the strap being installed thereon.
Figure 44:
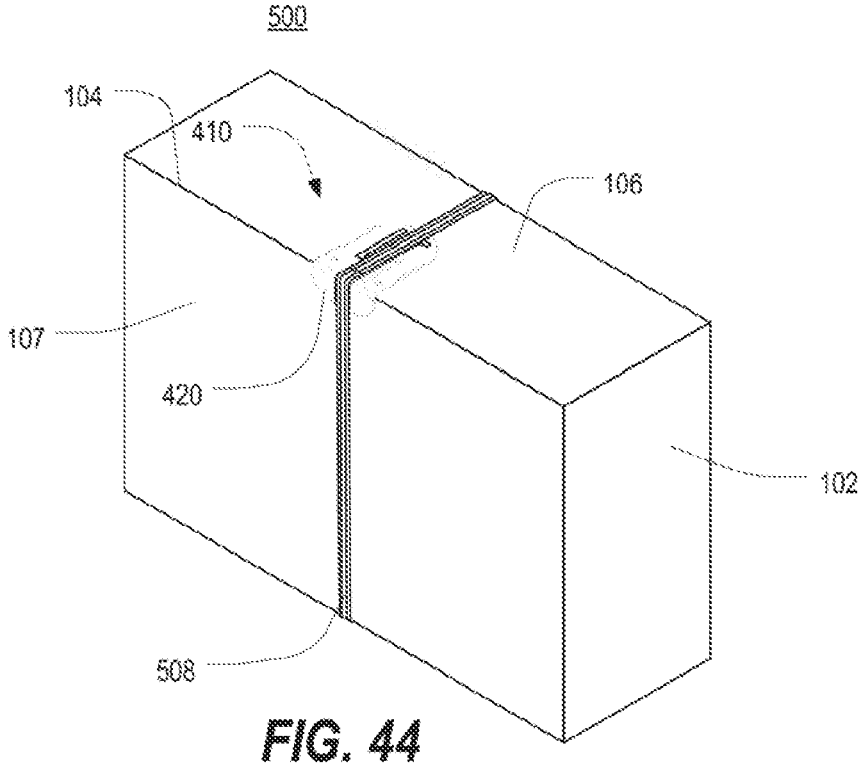
FIG. 44 is an orthogonal view of the merchandise item of FIG. 37 showing the edge cleat and strap fully installed thereon.

As with the edge cleat 220 of FIGS. 25-27, the edge cleat 420 of FIGS. 38 and 40 is well-suited to be attached to the edge of a merchandise box 102 such that the first portion 422 of the cleat 420 is placed against one face 106 of the box 102 and the second portion 426 of the cleat 420 is placed against an adjoining face 107 of the box 102, as shown in FIG. 42. One end of the conductive tape 508 is preferably placed in, and adhered to, the shallow channel 430 near the raised bumper wall 437, as shown in FIG. 43. The conductive tape 508 is then wrapped around the box 102 until the opposite end may be placed on, and adhered to, the shallow channel 430 on the other side of the raised bumper wall 437. Such opposite end may, in some cases, be overlapped on top of the first end of the conductive tape 508, as shown in FIG. 44; the raised bumper wall 437 helps prevent accidental contact between one end of the conductors 519 and the other. When the conductive tape 508 is properly attached, the conductors 519 make contact with a first contact tab 488 at one end and with the other contact tab 489 at the opposite end, thereby completing one or more sense loop between the sense loop contacts 72 of the tag assembly 40 when the tag assembly 40 is attached as shown in FIG. 37.

As with prior-described cleats, this cleat 420 includes one or more lock apertures 34 and a box sensor opening 36 and supports the functionality described previously. Similarly, the tag assembly 40 may be identical to that of previous embodiments. The alarm system is preferably armed when the tag assembly 40 is seated on the edge cleat 320, and an alarm state is entered (thereby triggering an alarm) when either or both 1) there is a break in the sense loop (for example, if the tag assembly 40 is removed, or if some portion of the conductive tape 508 is severed), or the box proximity sensor 56 is removed from the box 102, thereby releasing the switch 58. The alarm system may additionally or alternatively be configured to enter an alarm state, and thus activate an alarm, based on the location of the EAS tag to the gates of the EAS security system.

Figure 45:
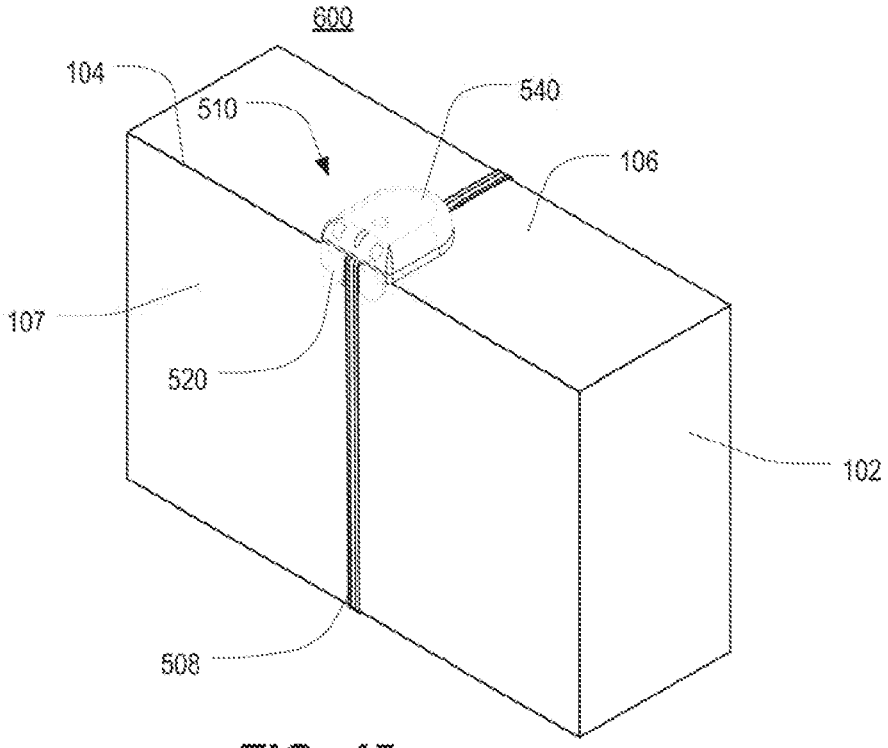
FIG. 45 is an orthogonal view of a merchandise item protected by another alternative box edge security device.
Figure 46:
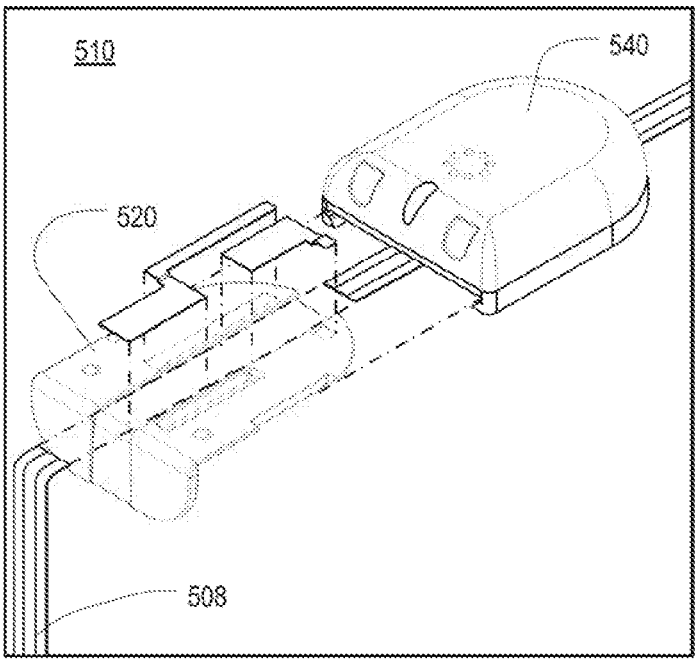
FIG. 46 is an exploded isometric view of the box edge security device of FIG. 45.

FIG. 45 is an orthogonal view of a merchandise item 500 protected by another alternative box edge security device 510 in accordance with one or more further preferred embodiments of the present invention, and FIG. 46 is an exploded isometric view of the box edge security device 510 of FIG. 45. Such a device 510 is very similar to the device 410 of FIG. 37, wherein the edge cleat is placed along an openable edge 104 of a merchandise box 102, and includes an edge cleat 520, a tag assembly 540, and a length of conductive tape 508.

The conductive tape 508 is similar to that of the device 410 of FIG. 37.

Figure 47:
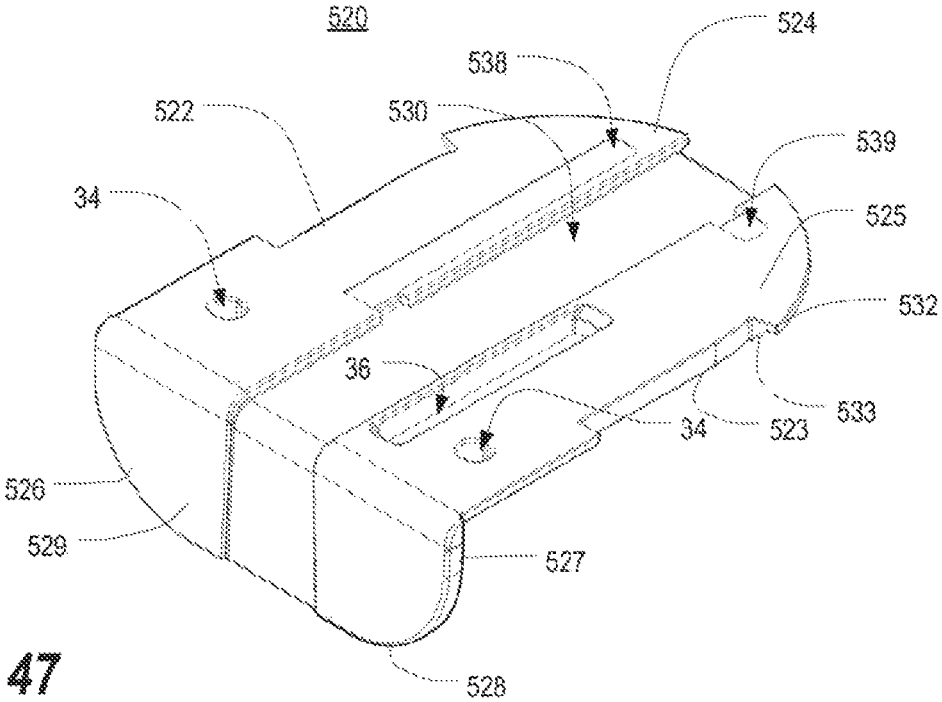
FIG. 47 is a top isometric view of the edge cleat of FIG. 46.
Figure 48:
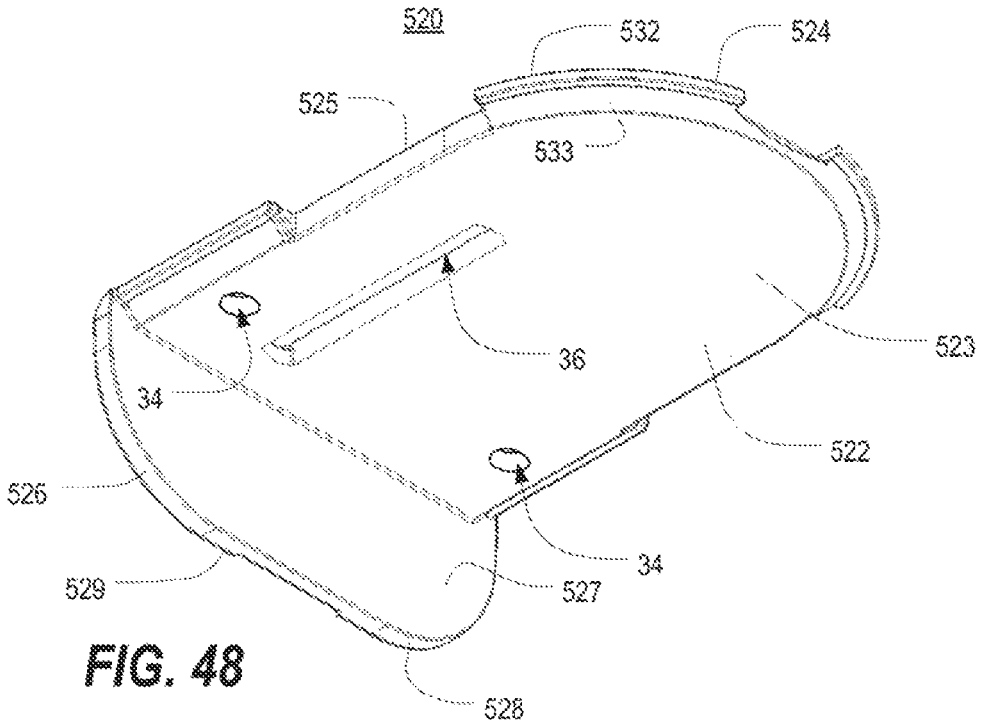
FIG. 48 is a bottom isometric view of the edge cleat of FIG. 46.
Figure 49:
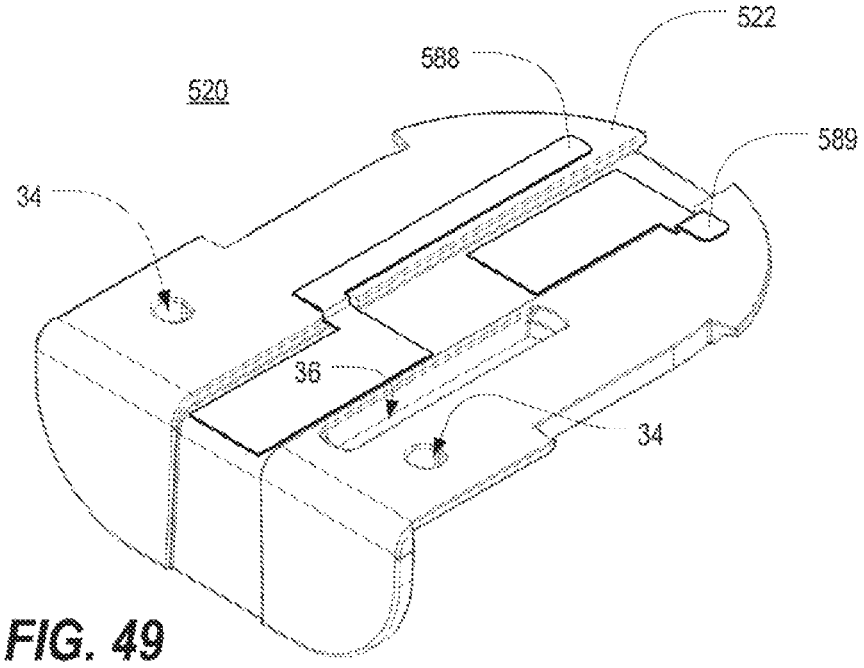
FIG. 49 is a top isometric view of the edge cleat of FIGS. 47 and 48, shown with contact tabs installed therein.

The two edge cleats 520,420 also have many similarities. FIGS. 47 and 48 are a top isometric view and a bottom isometric view, respectively, of the edge cleat 520 of FIG. 46. As with the edge cleat 420 of FIGS. 38 and 40, the edge cleat 520 of FIGS. 46-48 includes a first portion 522 and a second portion 526 whose underside surfaces 523,527 are generally flat and are arranged at angles to each other. The outer surface 525 of the first portion 522 includes a flat, shallow channel 530 similar to the channel 430 of the previous cleat 420. In at least some embodiments, the distal ends 224,228 of the first and second cleat portions 222,226 are curved so as to avoid corners that might be more easily pried from the box 102 and/or for some other purpose. The top (outer) surface 525 of the edge cleat 520 includes a pair of flat recesses 538,539 that are each aligned at a first end with a respective sense loop contact 72 on the bottom of the tag assembly 540, and that extend into the shallow channel 530 at their opposite end. Also, as shown in FIG. 49, each flat recess 538,539 carries a respective contact tab 588,589 that is arranged to make electrical contact with one of the sense loop contacts 72 at its first end. However, the portions of the recesses 538,539 and contact tabs 588,589 that are disposed in the shallow channel 530 are much larger than those of the previous edge cleat 420.

Figure 50:
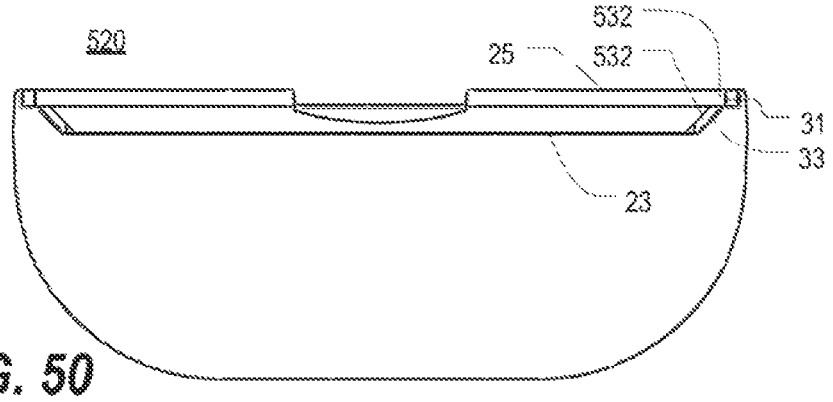
FIG. 50 is a rear view of the edge cleat of FIGS. 47 and 48.
Figure 51:
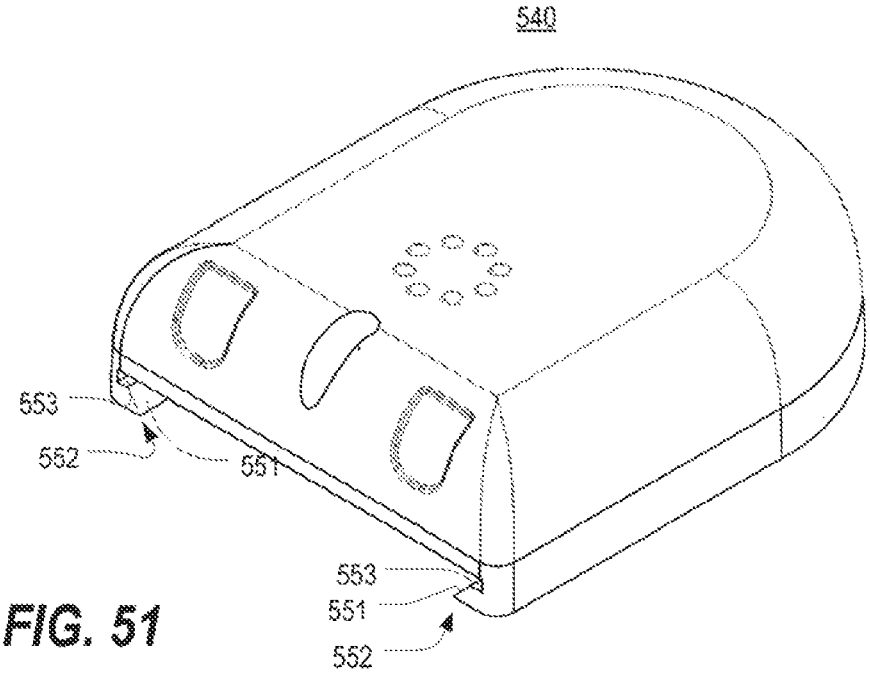
FIG. 51 is a top isometric view of the tag assembly of FIGS. 45 and 46.

The edge cleat 520 of FIGS. 47 and 48 also differs from that of FIG. 40 in its profile. In this regard, FIG. 50 is a rear view of the edge cleat 520 of FIGS. 47 and 48. As shown therein, the tag assembly interface 532 includes both an inwardly-angled surface 533 and an upper rim 531. Meanwhile, the tag assembly 540 is nearly identical to the tag assembly 40 described and illustrated previously, but the cleat interface 552 on the underside of the lower housing 543 has a profiled structure whose shape and contours correspond to the profiled edges of the tag assembly interface 532. In this regard, FIG. 51 is a top isometric view of the tag assembly 540 of FIGS. 45 and 46. As shown therein, the cleat interface 552 of the tag assembly 540 includes an angled lower surface 551 and a recessed upper ledge 553 extending discontinuously around a substantial portion of the periphery of the underside of the tag assembly 540. The angled lower surface 551 and recessed upper ledge 553 may be coupled or joined to the corresponding profile of the tag assembly interface 532 on the edge cleat 520 through lateral movement of the tag assembly 540 relative to the cleat 520.

Figure 52:
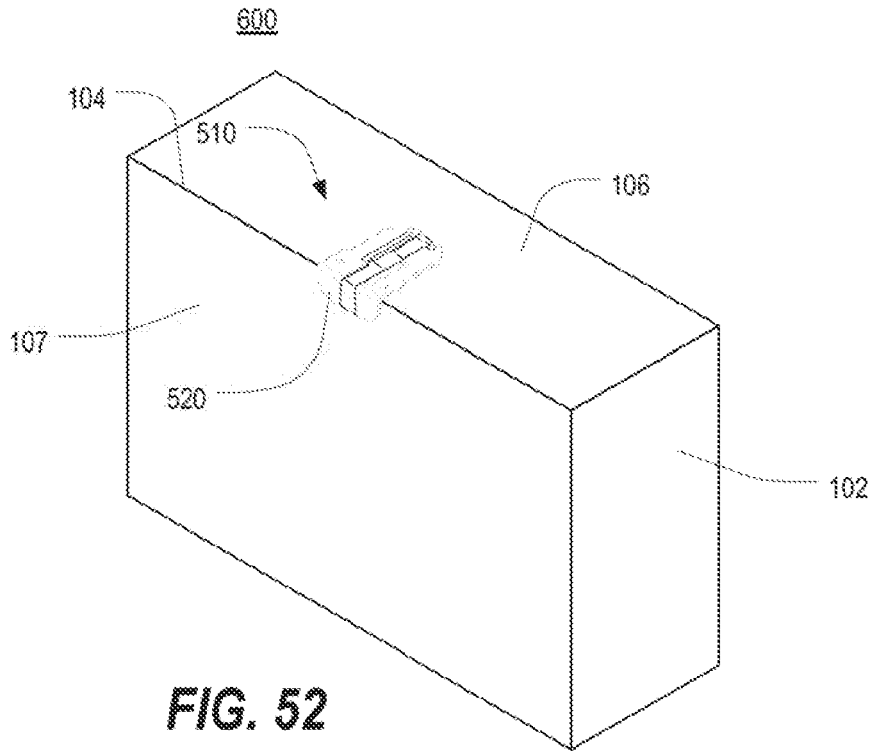
FIG. 52 is an orthogonal view of the merchandise item of FIG. 45 showing the edge cleat installed thereon.
Figure 53:
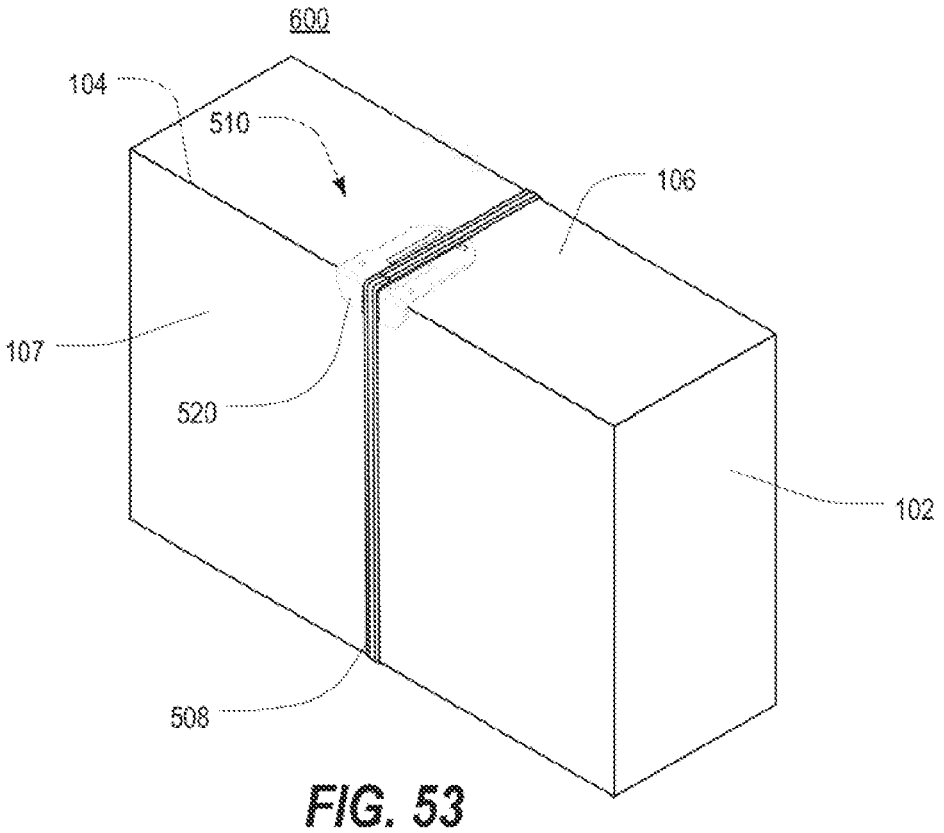
FIG. 53 is an orthogonal view of the merchandise item of FIG. 45 showing the edge cleat and strap installed thereon.

As with the edge cleat 420 of FIGS. 40 and 41, the edge cleat 520 of FIGS. 47-49 is well-suited to be attached to the edge of a merchandise box 102 such that the first portion 522 of the cleat 520 is placed against one face 106 of the box 102 and the second portion 526 of the cleat 520 is placed against an adjoining face 107 of the box 102, as shown in FIG. 52. One end of the conductive tape 508 is preferably placed in, and adhered to, the shallow channel 530, and the conductive tape 508 is then wrapped around the box 102. Such opposite end may, in some cases, be overlapped on top of the first end of the conductive tape 508, as shown in FIG. 53. When the conductive tape 508 is properly attached, the conductors 519 make contact with a first contact tab 588 at one end and with the other contact tab 589 at the opposite end, thereby completing one or more sense loop between the sense loop contacts 72 of the tag assembly 540 when the tag assembly 540 is attached as shown in FIG. 45.

As with prior-described cleats, this cleat 520 includes one or more lock apertures 34 and a box sensor opening 36 and supports the functionality described previously. Similarly, the functionality of the tag assembly 540 may be identical to that of the tag assembly 40 of previous embodiments. The alarm system is preferably armed when the tag assembly 540 is seated on the edge cleat 520, and an alarm state is entered (thereby triggering an alarm) when either or both 1) there is a break in the sense loop (for example, if the tag assembly 540 is removed, or if some portion of the conductive tape 508 is severed), or the box proximity sensor 56 is removed from the box 102, thereby releasing the switch 58. The alarm system may additionally or alternatively be configured to enter an alarm state, and thus activate an alarm, based on the location of the EAS tag to the gates of the EAS security system.

The security device 10,110,210,310,410,510 may also include an impact-resistant feature making it more difficult for a would-be thief to circumvent the locking features of the security device 10,110,210,310,410,510. One skilled in the art would appreciate the other improvements and enhancements that the security device 10,110,210,310,410,510, according to embodiments of the present invention, provides over some of the conventional security devices.

The distal ends of the first and second cleat portions have generally been described and illustrated as being curved so as to avoid corners that might be more easily pried from the box 102 and/or for some other purpose. However, the curvature may vary from that shown in the various drawings, and in some embodiments, shapes having vertices may be employed, particularly if their angles are relatively wide (and thus not sharp).

Notably, it will be appreciated that the present invention is embodied in a variety of electronic security devices for merchandise articles, and that although some such devices may include an on-board alarm system that activates in response to various conditions as well as an RFID, transmitter and/or receiver, or other element that can communicate with, or trigger, a transmitter/receiver or other device in the gate or other portion of a security system (such as may be conventionally located at the exit doors of a retail establishment), other electronic security devices may include only a portion of the functionality described herein. For example, in some embodiments, an electronic security device is provided that includes only an alarm that is activated if the edge cleat is removed from a box; in some embodiments, an electronic security device is provided that includes only an alarm that is activated if the tag assembly is removed from the edge cleat; and in some embodiments, an electronic security device is provided that may only be detected by gates of a security system located at the exit door of a retail establishment. A wide variety of alternative embodiments are likewise possible.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A box edge security device, for a merchandise box having adjacent structural portions connected together along an edge, comprising:

an edge cleat adapted to be attached around an edge of the merchandise box, the merchandise box having a first structural portion and a second structural portion that are connected to one another along the edge, such that a first portion of the edge cleat is disposed against the first structural portion of the merchandise box and a second portion of the edge cleat is disposed against the second structural portion of the merchandise box; and a tag assembly that interlocks with the edge cleat and includes an electronics assembly, contained within a housing, that forms at least part of an alarm system;

wherein the edge cleat is electrically conductive and forms a sense loop that is broken if the edge cleat is removed from the merchandise box.

2. The box edge security device of claim 1, wherein the electronics assembly includes an electronic article surveillance (EAS) tag.

3. The box edge security device of claim 1, wherein the tag assembly includes a lock plug that biased into engagement with the edge cleat and an aperture that engages the lock plug.

4. The box edge security device of claim 1, wherein the tag assembly includes a box sensor that detects the proximity of a merchandise box to the tag assembly.

5. The box edge security device of claim 4, wherein the box sensor includes a spring-loaded plunger that extends through an aperture in the edge cleat and contacts a surface of the merchandise box.

6. The box edge security device of claim 1, wherein the edge cleat includes two flat portions arranged at a right angle to one another and adapted to fit around the edge of a merchandise box whose first and second structural portions are flat.

7. The box edge security device of claim 6, wherein respective interlocking structures are provided near the periphery of the underside of the tag assembly and on an outwardly-facing surface of one of the two flat portions of the edge cleat, respectively, such that the tag assembly can be coupled to the edge cleat by sliding the tag assembly onto the edge cleat by sliding the respective interlocking structure of the tag assembly onto the respective interlocking structure of the edge cleat.

8. The box edge security device of claim 7, wherein the underside of the tag assembly includes a recessed groove near its periphery, wherein the edge cleat includes a profiled edge on the outwardly-facing surface, and wherein the recessed groove of the underside of the tag assembly couples with the profiled edge of the edge cleat to interlock the tag assembly to the edge cleat.

9. The box edge security device of claim 7, wherein the tag assembly includes a lock plug that is biased into engagement with the edge cleat such that the once the tag assembly is fully coupled onto the edge cleat by sliding the tag assembly onto the edge cleat via the interlocking structures of the tag assembly and the edge cleat, respectively, the tag assembly cannot be removed from the edge cleat until the lock plug is manually disengaged from the edge cleat.

10. The box edge security device of claim 6, wherein an outwardly-facing surface of one of the first and second structural portions of the edge cleat includes a flat channel that accommodates a strap around the merchandise box.

11. The box edge security device of claim 10, wherein a raised protuberance is arranged on each side of the flat channel and extends up into a recess in an underside of the tag assembly to prevent the box edge security device from being moved sideways relative to the strap.

12. The box edge security device of claim 6, wherein the edge cleat is initially provided in a flat, unfolded configuration and is bent, folded, creased, or otherwise manipulated to fit around the edge of the merchandise box.

13. The box edge security device of claim 1, wherein the electronics assembly includes a user-perceptible alarm, and wherein removal of at least one of the edge cleat and the tag assembly from the merchandise box triggers the alarm.

14. A security device, for a merchandise box, comprising:

a cleat;

a tag assembly that interlocks with the cleat and includes an electronics assembly, contained within a housing, that forms at least part of an alarm system; and a conductive sense loop that is electrically connected to circuitry in the tag assembly such that the alarm system is triggered if the conductive sense loop is broken;

wherein the cleat, tag assembly, and conductive sense loop are adapted to be attached to a first structural portion of the merchandise box.

15. The security device of claim 14, wherein the conductive sense loop is embodied in a conductive sense layer attached directly to the first portion of the merchandise box.

16. The security device of claim 14, wherein the alarm system is triggered if the conductive sense layer is broken or the tag assembly or the tag assembly is removed from the conductive sense layer.

17. The box security device of claim 14, wherein the conductive sense layer is attached directly to the first structural portion of the merchandise box, wherein the cleat is attached over the conductive sense layer, and wherein the tag assembly is attached to the cleat.

18. The security device of claim 17, further comprising a protective layer that is attached to, and covers, the conductive sense layer, and wherein the cleat is attached to the protective layer.

19. The security device of claim 14, wherein the conductive sense layer is a conductive ink.

20. An edge cleat for a merchandise box that includes having adjacent first and second structural portions connected together along an edge, comprising:

a first portion adapted to be disposed against a first structural portion of the merchandise box;

a second portion adapted to be disposed against a second structural portion of the merchandise box, wherein the first structural portion and the second structural portion are connected to one another along an edge, and wherein the edge cleat is adapted to be attached around the edge;

one or more interface structures or elements that are adapted to interlock with a tag assembly;

wherein a top or outer surface of the first portion of the edge cleat includes a shallow channel for receiving a strap; and wherein a top or outer surface of the second portion of the edge cleat also includes a shallow channel, collinear with the shallow channel of the first portion of the edge cleat, for receiving the strap;

wherein the edge cleat is electrically conductive and configured to form a sense loop that is broken if the edge cleat is removed from the merchandise box.

* * * * *